US012358713B2

(12) United States Patent
Komatsu et al.

(10) Patent No.: US 12,358,713 B2
(45) Date of Patent: Jul. 15, 2025

(54) METHOD FOR CONSTRUCTING TRIPLE-SHELL TANK

(71) Applicant: KAWASAKI JUKOGYO KABUSHIKI KAISHA, Kobe (JP)

(72) Inventors: Takanori Komatsu, Kobe (JP); Masato Terabayashi, Kobe (JP); Makoto Nakayama, Kobe (JP); Teruaki Kinoshita, Kobe (JP); Yuji Namiki, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 18/724,030

(22) PCT Filed: Dec. 21, 2022

(86) PCT No.: PCT/JP2022/047096

§ 371 (c)(1),
(2) Date: Jun. 25, 2024

(87) PCT Pub. No.: WO2023/127637

PCT Pub. Date: Jul. 6, 2023

(65) Prior Publication Data

US 2025/0074695 A1 Mar. 6, 2025

(30) Foreign Application Priority Data

Dec. 27, 2021 (JP) ..... 2021-212500

(51) Int. Cl.
*B65D 88/02* (2006.01)
*B65D 81/38* (2006.01)
*B65D 88/08* (2006.01)

(52) U.S. Cl.
CPC ..... *B65D 88/02* (2013.01); *B65D 81/3881* (2013.01); *B65D 88/08* (2013.01)

(58) Field of Classification Search
CPC .... B65D 88/02; B65D 88/08; B65D 81/3881; B65D 88/06; B65D 90/12; B65D 90/024;
(Continued)

(56) References Cited

U.S. PATENT DOCUMENTS 9,546,495 B2 * 1/2017 Shiomi ..... E04B 7/102
2005/0144864 A1 * 7/2005 Skovholt ..... F17C 3/022 52/223.3
2015/0197953 A1 7/2015 Shiomi et al.

FOREIGN PATENT DOCUMENTS

JP S56-77474 A 6/1981
JP S6458776 A * 8/1987
(Continued)

OTHER PUBLICATIONS

Feb. 14, 2023 International Search Report issued in International Patent Application No. PCT/JP2022/047096.

*Primary Examiner* — Bayan Salone
(74) *Attorney, Agent, or Firm* — Oliff PLC

(57) ABSTRACT

A method for constructing a triple shell tank including an inner tank, an intermediate tank, and an outer tank each having a roof and a side plate. According to the construction method, an intermediate tank roof is temporarily fixed onto an inner tank roof to form a connected roof body, a guide side plate having a predetermined height is installed around the connected roof body, a sealing process is performed between an outer peripheral edge of the connected roof body and an inner face of the guide side plate to form a sealed space, air is supplied to the sealed space to air-raise the connected roof body, at least a part of an outer tank roof is formed on the intermediate tank roof of the air-raised connected roof body, and an outer tank side plate is installed around the guide side plate.

14 Claims, 24 Drawing Sheets

(58) Field of Classification Search
CPC ... E04H 7/04; E04H 7/06; F17C 3/022; F17C 2201/0109; F17C 2201/0119; F17C 2201/032; F17C 2201/052; F17C 2203/0341; F17C 2203/035; F17C 2203/0375; F17C 2203/0379; F17C 2203/0631; F17C 2203/0639; F17C 2203/0678; F17C 2209/221; F17C 2209/232; F17C 2221/012; F17C 2221/014; F17C 2221/017; F17C 2223/0161; F17C 2223/033
See application file for complete search history.

(56) References Cited

FOREIGN PATENT DOCUMENTS

| | | | | | |
|---|---|---|---|---|---|
| JP | S6354859 | B2 | * | 10/1988 | |
| JP | S64-058776 | A | | 3/1989 | |
| JP | H06158905 | A | * | 6/1994 | |
| JP | 10037513 | A | * | 2/1998 | |
| JP | H10-037513 | A | | 2/1998 | |
| JP | 11182064 | A | * | 7/1999 | |
| JP | H11182064 | A | * | 7/1999 | |
| JP | 2013043679 | A | * | 3/2013 | |
| JP | 5672787 | B2 | * | 2/2015 | |
| JP | 6127453 | B2 | * | 5/2017 | ..... E04B 7/10 |

* cited by examiner

METHOD FOR CONSTRUCTING TRIPLE-SHELL TANK

TECHNICAL FIELD

The present disclosure relates to a method for constructing a triple shell tank that stores a low temperature liquefied gas.

BACKGROUND ART

A flat-bottomed tank having a multi-shell structure is known as a facility for storing a low temperature liquefied gas. Construction of this type of multi-shell tank generally requires a long construction period because the construction structure itself is large in scale and impartment of a heat insulation structure is required. For example, Patent Literatures 1 and 2 disclose a method for constructing a tank having a double shell structure including an inner tank and an outer tank for the purpose of shortening of the construction period. In recent years, a flat-bottomed tank having a triple shell structure including an intermediate tank between an inner tank and an outer tank has been studied as a storage facility for a cryogenic liquefied gas.

Since the triple shell tank naturally has a complicated structure as compared with the double shell tank, the construction period of the triple shell tank tends to be longer.

CITATION LIST

Patent Literature

Patent Literature 1: Japanese Patent No. 6127453
Patent Literature 2: Japanese Patent No. 5672787

SUMMARY OF INVENTION

An object of the present disclosure is to provide a construction method that can shorten a construction period thereof in constructing a triple shell tank including an inner tank, an intermediate tank, and an outer tank.

Means for Solving the Problem

A method for constructing a triple shell tank according to an aspect of the present disclosure is a method for constructing a triple shell tank including an inner tank, an intermediate tank, and an outer tank each having a roof and a side plate, the method including: temporarily fixing an intermediate tank roof onto an inner tank roof to form a connected roof body; installing a guide side plate having a predetermined height around the connected roof body; performing a sealing process between an outer peripheral edge of the connected roof body and an inner face of the guide side plate to form a sealed space, and supplying air to the sealed space to air-raise the connected roof body; and forming at least a part of an outer tank roof on the intermediate tank roof of the air-raised connected roof body, and installing an outer tank side plate around the guide side plate.

Advantageous Effects of the Invention

According to the present disclosure, it is possible to provide a construction method that can shorten a construction period thereof in constructing a triple shell tank including an inner tank, an intermediate tank, and an outer tank.

DESCRIPTION OF EMBODIMENTS

Hereinafter, embodiments of the method for constructing the triple shell tank according to the present disclosure will be described in detail with reference to the drawings. The triple shell tank that is a construction target of the present disclosure is a tank that stores a low temperature liquefied gas, and is a flat-bottomed tank having a ground installation triple shell structure. The liquefied gas to be stored is, for example, liquefied hydrogen, liquid helium, or liquid nitrogen.

[Structure of Triple-Shell Tank]

Figure 1:
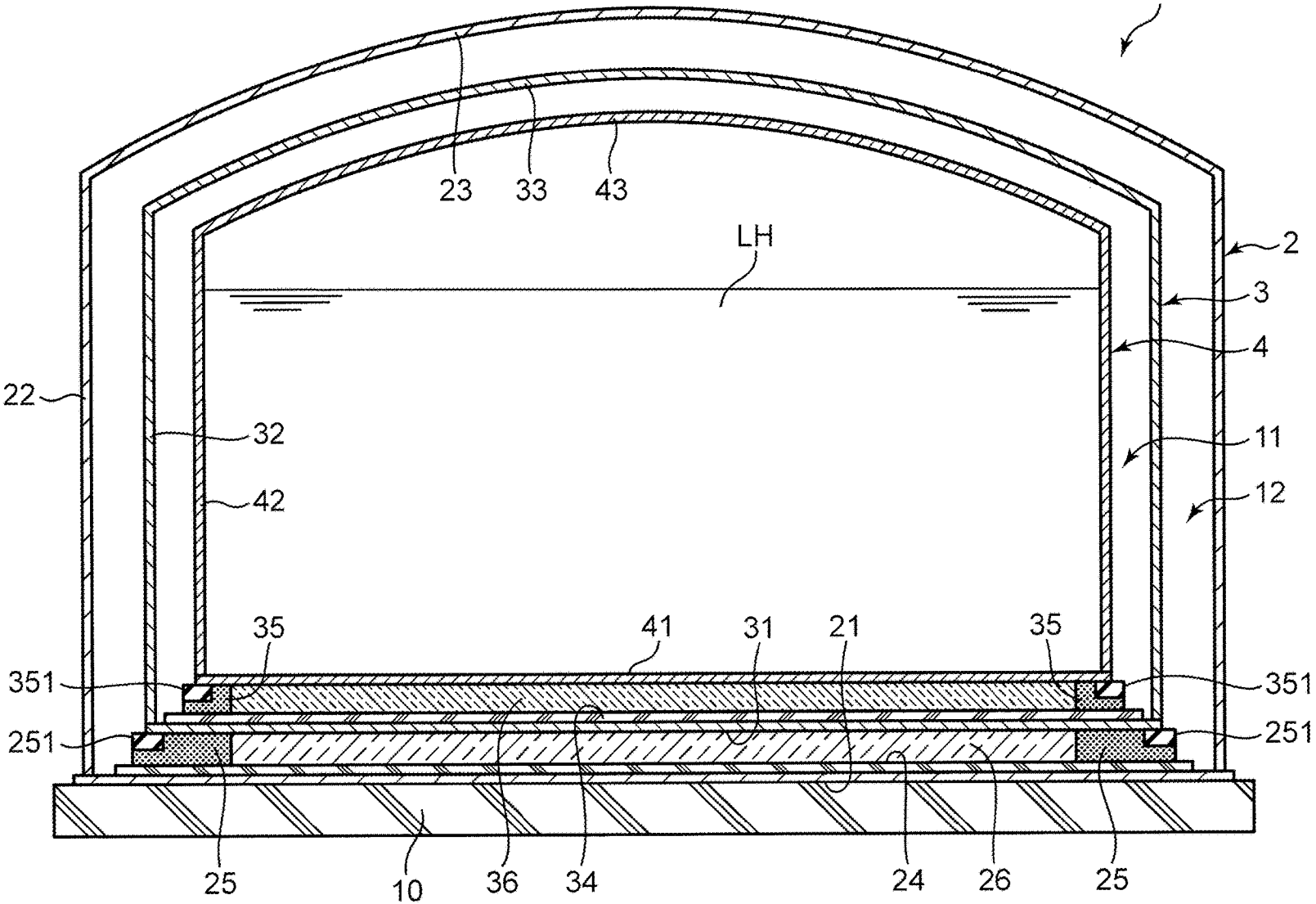
FIG. 1 is a longitudinal cross-sectional view illustrating a structure of a triple shell tank that becomes a construction target according to the present disclosure.

First, the structure of a triple shell tank 1 that becomes a construction target according to the present disclosure will be described with reference to the longitudinal cross-sectional view illustrated in FIG. 1. FIG. 1 illustrates a triple shell tank 1 that stores liquid hydrogen LH. The triple shell tank 1 includes a tank base 10, an outer tank 2 erected on the tank base 10, an intermediate tank 3 contained in the outer tank 2, and an inner tank 4 contained in the intermediate tank 3. The outer tank 2, the intermediate tank 3, and the inner tank 4 each have a circular shape in top view, and are disposed concentrically.

The tank base 10 is a concrete layer constituting a base portion of the triple shell tank 1. The tank base 10 has a size larger than an outer diameter of the outer tank 2. The outer tank 2 is a sealed body made of metal such as carbon steel, and includes an outer tank bottom plate 21, an outer tank side plate 22, and an outer tank roof 23. The outer tank bottom plate 21 is laid immediately above the tank base 10, and has a disk shape. The outer tank side plate 22 is erected from a peripheral edge of the outer tank bottom plate 21 and has a cylindrical shape. The outer tank roof 23 is attached to the upper end of the outer tank side plate 22 so as to close an upper surface opening of the outer tank side plate 22 having a cylindrical shape, and has a dome shape.

The intermediate tank 3 is a sealed body made of metal such as SUS, and is disposed inside the outer tank 2. The intermediate tank 3 includes an intermediate tank bottom plate 31, an intermediate tank side plate 32, and an intermediate tank roof 33. The intermediate tank bottom plate 31 has a disk shape having a diameter smaller than that of the outer tank bottom plate 21. The intermediate tank side plate 32 is erected from a peripheral edge of the intermediate tank bottom plate 31 and has a cylindrical shape. The intermediate tank roof 33 is attached to the upper end of the intermediate tank side plate 32 and has a dome shape.

A first level concrete layer 24, a first ring portion 25, and an outer bottom portion cool layer 26 are interposed between the outer tank bottom plate 21 and the intermediate tank bottom plate 31. The first level concrete layer 24 is a flattened concrete layer constructed on the outer tank bottom plate 21. The first ring portion 25 is a high-strength concrete layer arranged in a ring shape on the vicinity of the peripheral edge of the first level concrete layer 24. A reinforced concrete layer 251 is disposed at a part of the first ring portion 25 that directly receives a load of the intermediate tank side plate 32. The outer bottom portion cool layer 26 is a layer having a heat insulating property disposed on the first level concrete layer 24 and inside the first ring portion 25. The first ring portion 25 can be formed of an array body of insulating concrete blocks such as perlite concrete blocks. The outer bottom portion cool layer 26 can be formed of an array body of insulating inorganic block materials such as foam glass. For example, a plate material of lightweight aerated concrete may be laid on the outer bottom portion cool layer 26.

The inner tank 4 is a tank that actually stores liquid, is a sealed body made of metal such as SUS, and is disposed inside the intermediate tank 3. The inner tank 4 includes an inner tank bottom plate 41, an inner tank side plate 42, and an inner tank roof 43. The inner tank bottom plate 41 has a disk shape having a diameter smaller than that of the intermediate tank bottom plate 31. The inner tank side plate 42 is erected from a peripheral edge of the inner tank bottom plate 41 and has a cylindrical shape. The inner tank roof 43 is attached to the upper end of the inner tank side plate 42 and has a dome shape. The liquid hydrogen LH is stored inside the inner tank 4.

A second level concrete layer 34, a second ring portion 35, and an inner bottom portion cool layer 36 are interposed between the intermediate tank bottom plate 31 and the inner tank bottom plate 41. The second level concrete layer 34 is constructed on the intermediate tank bottom plate 31. The second ring portion 35 is a high-strength concrete layer arranged in a ring shape on the vicinity of the peripheral edge of the second level concrete layer 34. A reinforced concrete layer 351 is disposed at a part of the second ring portion 35 that directly receives a load of the inner tank side plate 42. The inner bottom portion cool layer 36 is a layer having a heat insulating property disposed on the second level concrete layer 34 and inside the second ring portion 35. For example, the second ring portion 35 can be formed of a perlite concrete block, and the inner bottom portion cool layer 36 can be formed of a foam glass block or the like. For example, a plate material of lightweight aerated concrete may be laid on the inner bottom portion cool layer 36.

A gap having a predetermined width is provided between the inner tank 4 and the intermediate tank 3 and between the intermediate tank 3 and the outer tank 2. A first inter-vessel 11, which is a gap between the inner tank 4 and the intermediate tank 3, and a second inter-vessel 12, which is a gap between the intermediate tank 3 and the outer tank 2, are filled with a heat insulation material. As the heat insulation material, perlite or glass wool can be used. The first inter-vessel 11 is filled with a low-boiling gas equivalent to the liquid hydrogen LH stored in the inner tank 4, for example, hydrogen gas. The second inter-vessel 12 is filled with nitrogen gas.

[Method for Constructing Triple-Shell Tank]

Next, the method for constructing the triple shell tank 1 illustrated in FIG. 1 will be described. The construction method of the present disclosure is characterized to include the following steps (1) to (4).

(1) The intermediate tank roof 33 is temporarily fixed on the inner tank roof 43 to form a connected roof body.
(2) A guide side plate having a predetermined height is installed around the connected roof body.
(3) A sealing process is performed between an outer peripheral edge of the connected roof body and an inner face of the guide side plate to form a sealed space, and air is supplied to the sealed space to air-raise the connected roof body.
(4) The outer tank roof 23 is formed on the air-raised intermediate tank roof 33, and the outer tank side plate 22 is installed around the guide side plate.

According to such the method for constructing the triple shell tank 1, the inner tank roof 43 and the intermediate tank roof 33 can be integrally floated by the air-raising of the connected roof body. That is, the inner tank roof 43 and the intermediate tank roof 33 can be prepared by ground work, temporarily fixed, and integrated, and can be floated at once by one time of air-raising. Accordingly, most of the installation work of the inner tank roof 43 and the intermediate tank roof 33 can be executed by a low-place work in parallel with the installation work of the side plates 22, 32, and 42, and the like, which can contribute to shortening of the construction period.

Here, the guide side plate of the step (2) can be installed as the inner tank side plate 42 or the intermediate tank side plate 32. In a case of a method (hereinafter, called inner tank AR method) of air-raising the connected roof body with the inner tank side plate 42 as a guide side plate, what is directly air-raised is the inner tank roof 43, but the intermediate tank roof 33 is also integrally floated in an aspect of being supported from below by the inner tank roof 43. In a case of a method (hereinafter, called intermediate tank AR method) of air-raising the connected roof body with the intermediate tank side plate 32 as a guide side plate, what is directly air-raised is the intermediate tank roof 33, but the inner tank roof 43 is also integrally floated in an aspect of being suspended from the intermediate tank roof 33. In the following description, the inner tank AR method will be described as the first embodiment, and the intermediate tank AR method will be described as the second embodiment.

First Embodiment; Inner Vessel AR Method

Figure 2:
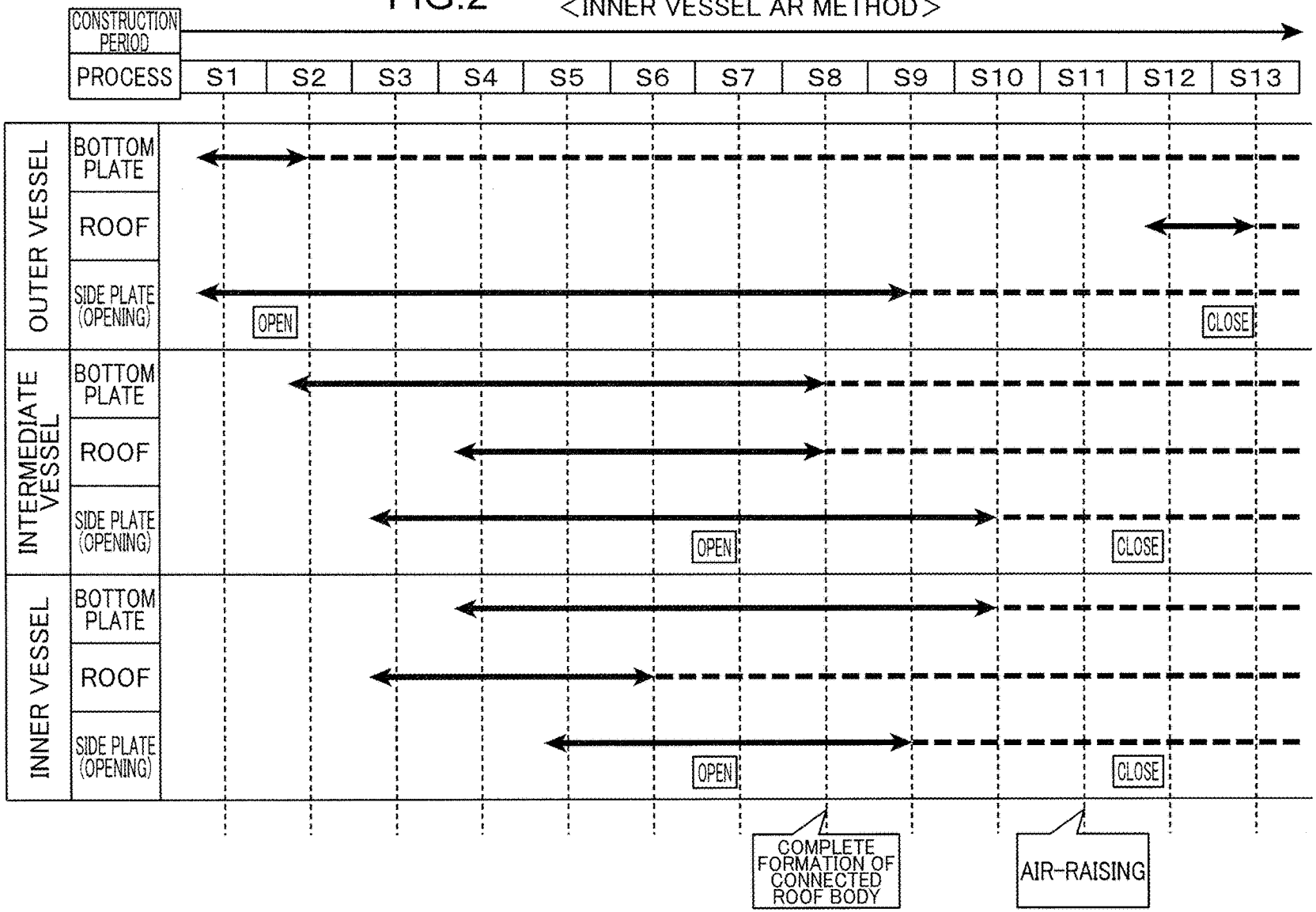
FIG. 2 is a process chart of a method for constructing a triple shell tank according to a first embodiment (inner tank AR method) of the present disclosure.

FIG. 2 is a process chart showing one embodiment of the method for constructing the triple shell tank 1 according to the first embodiment. FIG. 2 shows the relationship between processes S1 to S13 performed during the construction period of the triple shell tank 1 and the construction time of each part of the triple shell tank 1. Specifically, for each of the bottom plates 21, 31, and 41, the roofs 23, 33, and 43, and the side plates 22, 32, and 42 of the outer tank 2, the intermediate tank 3, and the inner tank 4, the construction period during which the main construction work is actually performed is indicated by the solid arrows, and the period after the construction is indicated by the dotted lines, each of which is shown in FIG. 2. Regarding the side plates 22, 32, and 42, opening timing of a construction opening, which is a construction entrance, is indicated as "open", and sealing timing of the construction opening is indicated as "close". Note that processes S1 to S13 are not necessarily divided in units of processes serving as a division of a tank construction procedure, and the progress status of construction may be simply divided as "process".

As also shown in FIG. 2, a characteristic point of the construction method of the present embodiment lies in forming, by ground work (process S8), a connected roof body formed by temporarily fixing the intermediate tank roof 33 and the inner tank roof 43, and floating (process S11) the connected roof body by air-raising. FIGS. 3 to 15 are views schematically illustrating construction states of the triple shell tank 1 in processes S1 to S13 shown in FIG. 2, respectively. FIGS. 3 to 15 illustrate, with a cross section, a part corresponding to half from a radial center RC of the triple shell tank 1. Hereinafter, each of processes S1 to S13 will be described with reference to FIGS. 3 to 15.

<Process S1>

Figure 3:
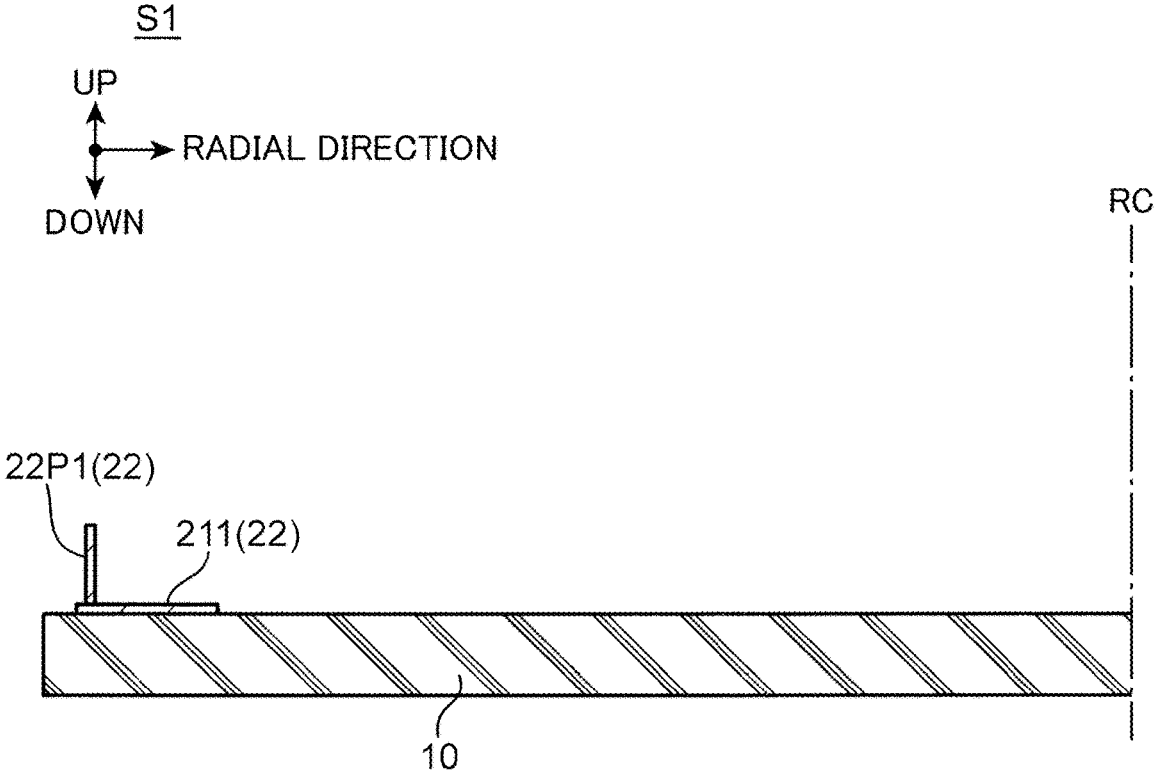
FIG. 3 is a view illustrating, with a cross section of half of the tank, one process of the method for constructing the triple shell tank according to the first embodiment.

FIG. 3 illustrates a construction status in process S1. In process S1, a part of the outer tank 2 is installed on the tank base 10. Specifically, an outer tank annular 211 constituting a part of the outer tank bottom plate 21 and an outer tank side plate piece 22P1 constituting a part of the outer tank side plate 22 are installed in the vicinity of a peripheral edge part of the tank base 10. The outer tank annular 211 constitutes a circular part in the vicinity of the outer periphery of the outer tank bottom plate 21 having a disk shape, and becomes a portion positioned below the first ring portion 25. The outer tank annular 211 has a plate thickness thicker than other part of the outer tank bottom plate 21 in order to improve load bearing property.

The outer tank side plate 22 is assembled by using a plurality of side plate pieces formed of a rectangular plate gently curved in an arc shape. Specifically, the side plate pieces are arranged in a circular ring shape, and adjacent side plate pieces are welded to form one circular step. By stacking a plurality of such circular steps, the outer tank side plate 22 is installed. The outer tank side plate piece 22P1 illustrated in FIG. 3 is a side plate piece constituting the lowermost circular step of the outer tank side plate 22. The outer tank side plate piece 22P1 is erected vertically upward from a slightly inner side of a radially outer peripheral edge of the outer tank annular 211.

<Process S2>

Figure 4:
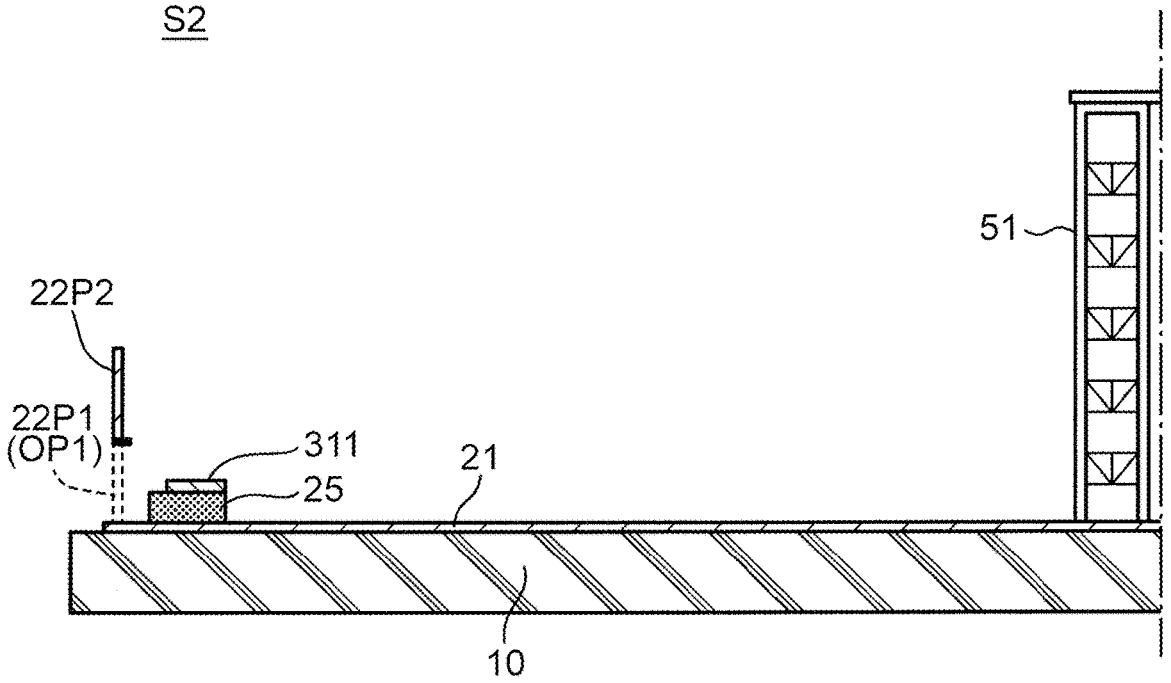
FIG. 4 is a view illustrating one process of the method for constructing the triple shell tank.

FIG. 4 illustrates a construction status in process S2. In process S2, construction of the outer tank bottom plate 21, the outer tank side plate 22, and the first ring portion 25 is performed. Regarding the outer tank bottom plate 21, a radially inner part of the outer tank annular 211 is laid. This inner part is a part positioned immediately below the outer bottom portion cool layer 26. Although not illustrated in FIG. 4, the first level concrete layer 24 illustrated in FIG. 1 is placed on the outer tank bottom plate 21 after being laid. First, a part of the first level concrete layer 24 is placed on the outer tank annular 211. Thereafter, after the inner tank roof 43 and the intermediate tank roof 33 are installed to eliminate the risk of rainwater infiltration, the remaining part of the first level concrete layer 24 is placed on the inner part of the outer tank annular 211.

Regarding the outer tank side plate 22, an outer tank side plate piece 22P2 constituting a second circular step is installed on the outer tank side plate piece 22P1 constituting the lowermost circular step. Note that after installation of the second circular step, the lowermost circular step is provided with a first opening OP1, which becomes a construction opening. The first opening OP1 is opened by pulling out one or a plurality of the plurality of outer tank side plate pieces 22P1 constituting the lowermost circular step. Specifically, after the plurality of outer tank side plate pieces 22P1 are arranged in a circular shape to once form a circular step, only the outer tank side plate piece 22P1 corresponding to the position of the first opening OP1 is not welded to the adjacent piece, and is removed from the circular step.

Blocks constituting the first ring portion 25 are laid on the upper surface in the vicinity of the radially outer periphery of the outer tank bottom plate 21. Furthermore, an intermediate tank annular 311 constituting a part of the intermediate tank bottom plate 31 is installed on the first ring portion 25. The intermediate tank annular 311 is a circular part in the vicinity of the outer periphery of the intermediate tank bottom plate 31 having a disk shape, and has a plate thickness thicker than the other part of the intermediate tank bottom plate 31. In addition to the above, a center roof support 51 is placed in the vicinity of the radial center RC of the outer tank bottom plate 21. The center roof support 51 is a frame for enabling the dome type inner tank roof 43 to be installed on the ground side before air-raising.

<Process S3>

Figure 5:
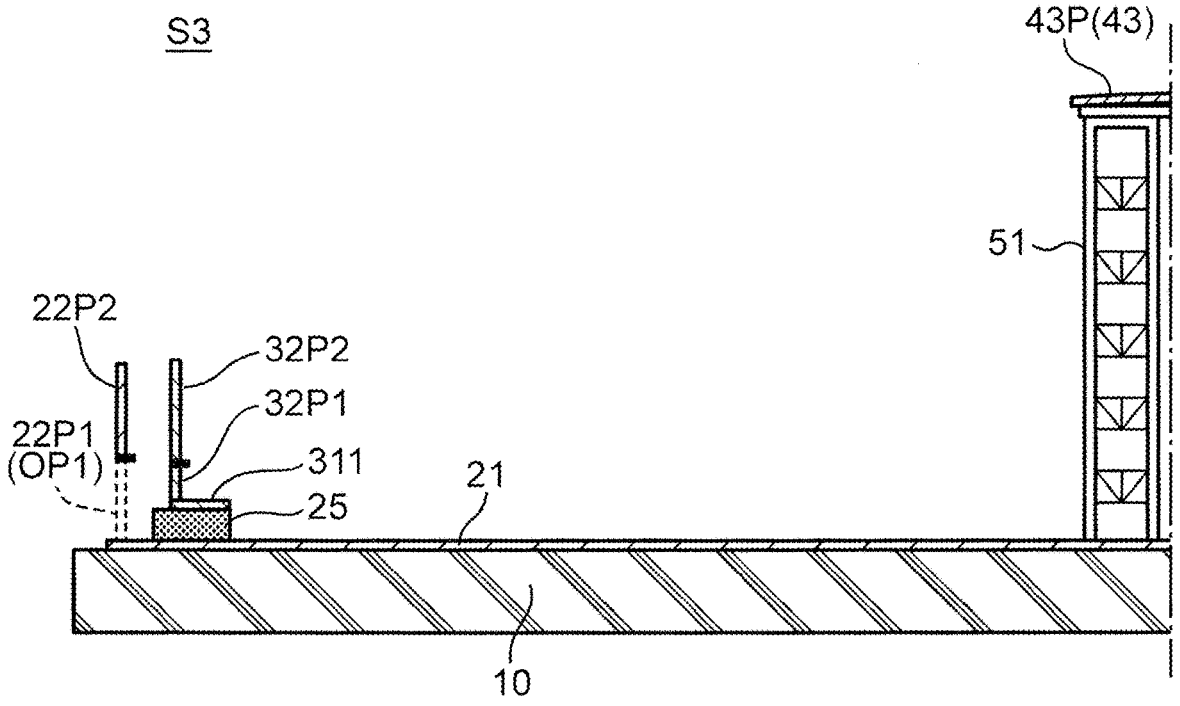
FIG. 5 is a view illustrating one process of the method for constructing the triple shell tank.

FIG. 5 illustrates a construction status in process S3. In process S3, installation of the intermediate tank side plate 32 and the inner tank roof 43 is started. Regarding the intermediate tank side plate 32, intermediate tank side plate pieces 32P1 and 32P2 are installed on the intermediate tank annular 311 already provided. The intermediate tank side plate pieces 32P1 and 32P2 are erected vertically upward from a radially outer peripheral edge of the intermediate tank annular 311. The intermediate tank side plate pieces 32P1 and 32P2 are side plate pieces constituting the lowermost circular step and the second circular step of the intermediate tank side plate 32, respectively. The lowermost intermediate tank side plate piece 32P1 is also a side plate piece that matches the height of the second circular step of the intermediate tank side plate 32 with the height of the lowermost circular step of the inner tank side plate 42 to be installed later.

Regarding the inner tank roof 43, an inner tank roof piece 43P is installed on the center roof support 51 placed in the previous process S2. The installed inner tank roof piece 43P constitutes the vicinity of the radial center of the inner tank roof 43.

<Process S4>

Figure 6:
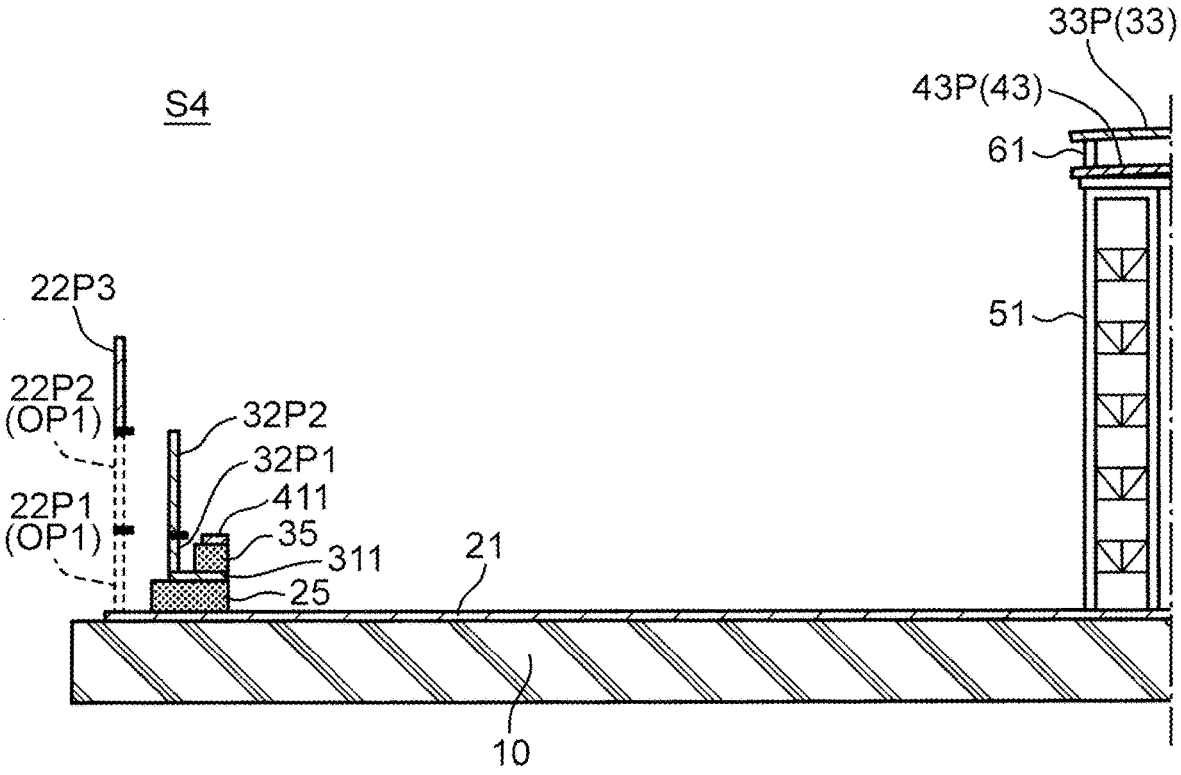
FIG. 6 is a view illustrating one process of the method for constructing the triple shell tank.

FIG. 6 illustrates a construction status in process S4. In process S4, the construction of the outer tank side plate 22 is continued, and installation of the intermediate tank roof 33 is started. The latter is also the beginning of formation of the connected roof body. Regarding the outer tank side plate 22, an outer tank side plate piece 22P3 constituting a third circular step is installed on the outer tank side plate piece 22P2 constituting the second circular step. Similarly to the above, after installation of the third circular step, one or a plurality of the outer tank side plate pieces 22P2 in the second circular step are pulled out, thereby opening the first opening OP1, which becomes a construction opening. The outer tank side plate piece 22P2 to be pulled out is a piece positioned immediately above the outer tank side plate piece 22P1 pulled out for opening the first opening OP1 in the lowermost circular step. The reason for opening the first opening OP1 at a height corresponding to two circular steps in the outer tank side plate 22 is to match the opening height to the construction opening to be opened in the intermediate tank side plate 32 and the inner tank side plate 42 where the installation is started from a position higher than the outer tank side plate 22.

Regarding the intermediate tank roof 33, an intermediate tank roof piece 33P constituting the vicinity of the radial center of the intermediate tank roof 33 is installed on the inner tank roof piece 43P previously installed on the center roof support 51. In this installation, an intermediate tank roof support 61 is used. The intermediate tank roof support 61 is interposed between the inner tank roof 43 and the intermediate tank roof 33, and temporarily fixes the both at a predetermined interval. As the intermediate tank roof support 61, a member having rigidity such as H steel can be used. The temporary fixing can be performed in an aspect in which, for example, the lower end part of the H steel is welded and fixed to the inner tank roof piece 43P via a predetermined backing plate, and the intermediate tank roof piece 33P is placed and fixed on the upper end part of the H steel.

In addition to the above, in process S4, a block constituting the second ring portion 35 is laid on the intermediate tank annular 311. An inner tank annular 411 is installed on the upper surface of the second ring portion 35. The inner tank annular 411 is a circular part in the vicinity of the outer periphery of the inner tank bottom plate 41 having a disk shape.

<Process S5>

Figure 7:
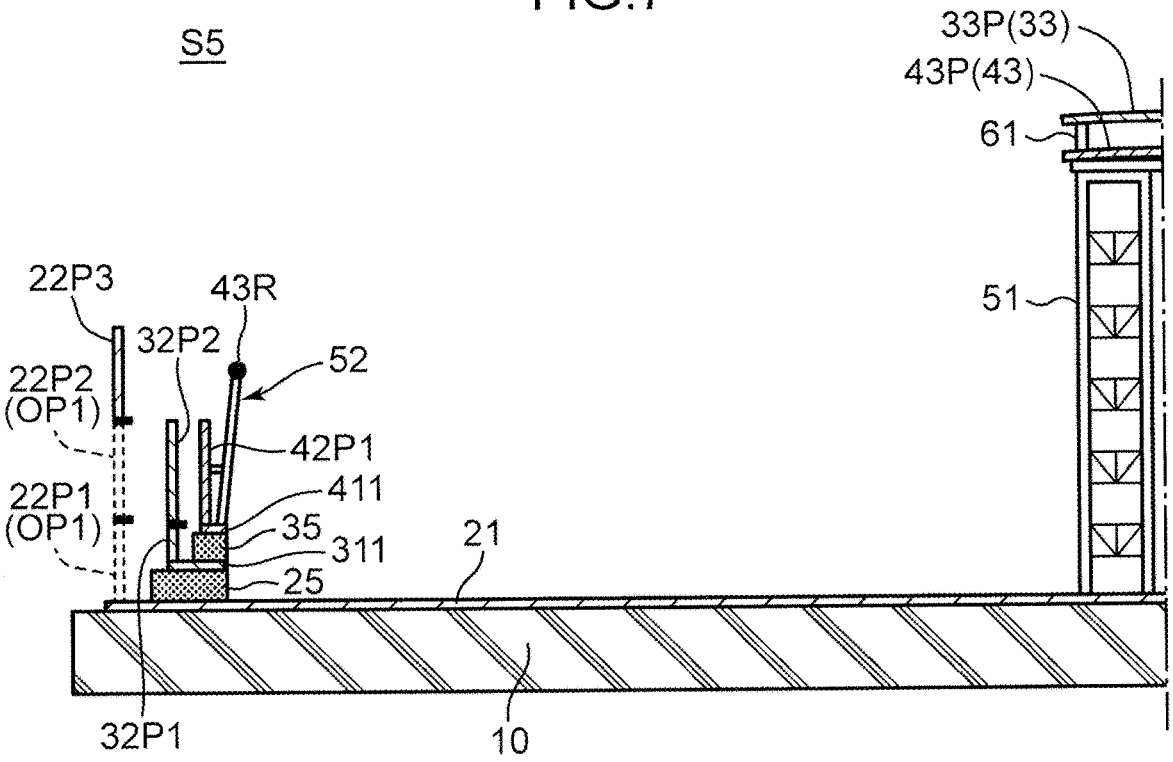
FIG. 7 is a view illustrating one process of the method for constructing the triple shell tank.

FIG. 7 illustrates a construction status in process S5. In process S5, installation of the inner tank side plate 42 is started. The inner tank side plate 42 is also assembled by stacking a plurality of circular steps formed by arranging a plurality of side plate pieces in a circular ring shape. An inner tank side plate piece 42P1 constituting the lowermost circular step of the inner tank side plate 42 is installed on the inner tank annular 411. The inner tank side plate piece 42P1 is erected vertically upward from a radially outer peripheral edge of the inner tank annular 411.

In addition to this, in process S5, an outer periphery roof support 52 is placed. The outer periphery roof support 52 is a frame temporarily supporting the outer peripheral lower edge of the inner tank roof 43. The outer periphery roof support 52 is a frame erected in a state of being slightly inclined radially inward from the vicinity of an inner peripheral edge of the inner tank annular 411. An upper end of the outer periphery roof support 52 is attached with an outer periphery ring 43R of the inner tank roof 43.

<Process S6>

Figure 8:
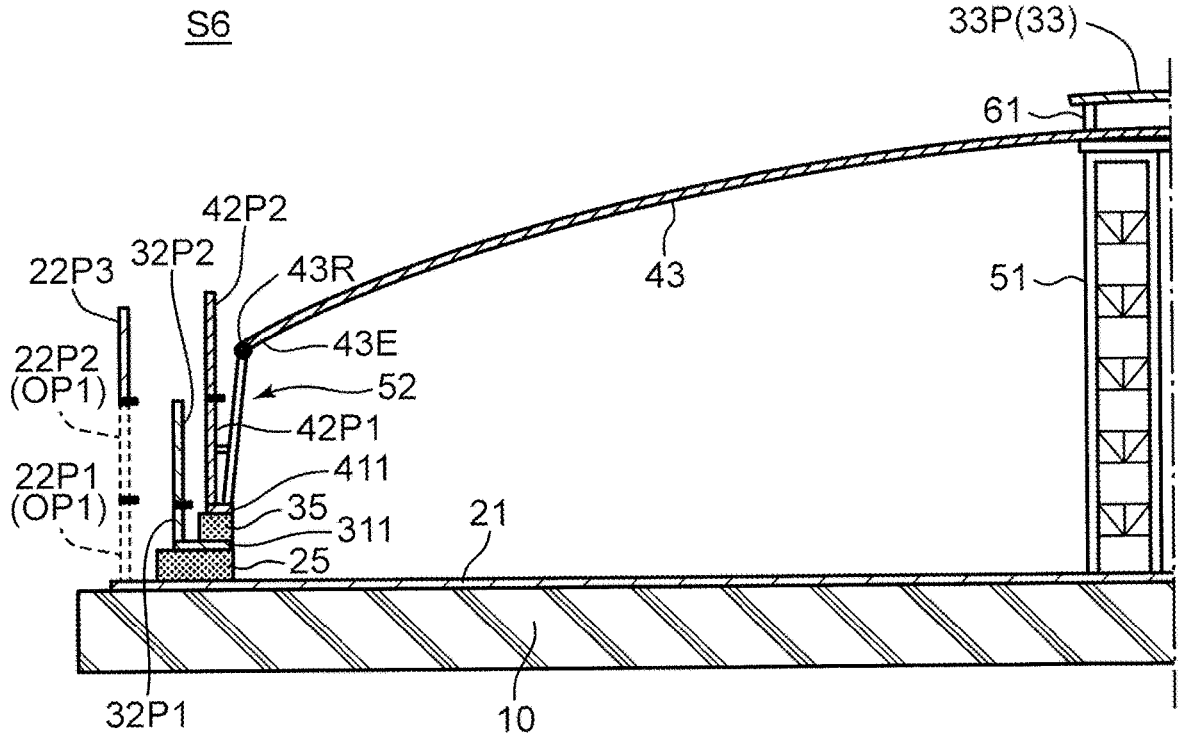
FIG. 8 is a view illustrating one process of the method for constructing the triple shell tank.

FIG. 8 illustrates a construction status in process S6. In process S6, the installation of the inner tank side plate 42 and the inner tank roof 43 is continued. Regarding the inner tank side plate 42, an inner tank side plate piece 42P2 constituting a second circular step is installed on the lowermost inner tank side plate piece 42P1. Regarding the inner tank roof 43, the inner tank roof 43 having a dome shape is finally formed by connecting between the inner tank roof piece 43P, which is temporarily supported by the center roof support 51, and the outer periphery roof support 52 with an inner tank roof block assembled in advance by ground work. The inner tank roof block includes a roof skeleton serving as a support frame and a plurality of roof plates attached to this roof skeleton. An outer peripheral edge 43E of the inner tank roof 43 is fixed to the outer periphery ring 43R held by the outer periphery roof support 52. Due to this, the inner tank roof 43 is completed. At this time point, the inner tank roof 43 is supported by the outer periphery roof support 52 and brought into a self-standing state, and therefore the center roof support 51 is removed.

<Process S7>

Figure 9:
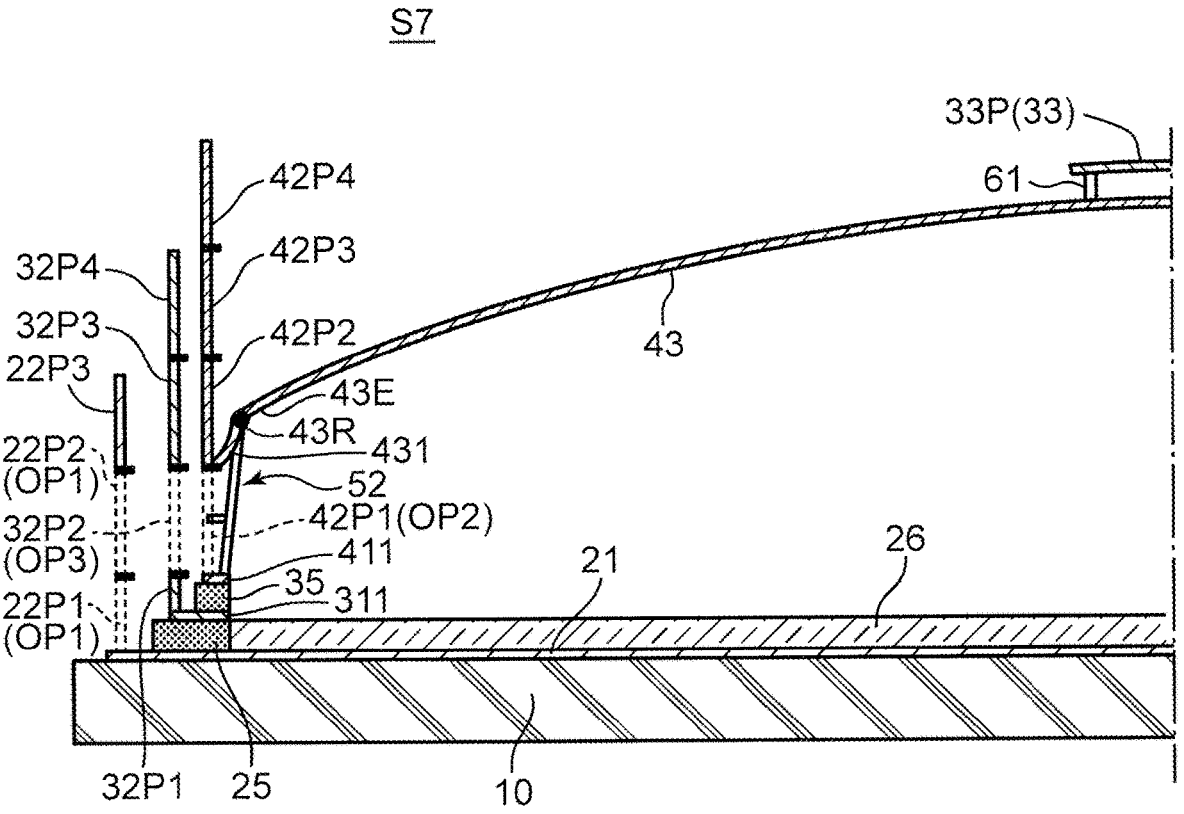
FIG. 9 is a view illustrating one process of the method for constructing the triple shell tank.

FIG. 9 illustrates a construction status in process S7. In process S7, the installation of the inner tank side plate 42 and the intermediate tank side plate 32 is continued, and the inner tank roof 43 is attached with a temporary roof 431. Regarding the inner tank side plate 42, an inner tank side plate piece 42P3 constituting the third circular step is installed on the inner tank side plate piece 42P2 constituting the second circular step. Furthermore, the side plate height is sequentially raised in such a manner that a fourth inner tank side plate piece 42P4 is installed thereon.

When the inner tank side plate 42 is installed, a second opening OP2 is provided as a construction opening. The second opening OP2 is opened by forming the second circular step with the plurality of inner tank side plate pieces 42P2 and then pulling out one or a plurality of the plurality of inner tank side plate pieces 42P1 constituting the lowermost circular step. The opening position of the second opening OP2 is a position corresponding to the first opening OP1 opened in the outer tank side plate 22. Specifically, the second opening OP2 and the first opening OP1 are opened at substantially the same position in the circumferential direction of the triple shell tank 1, and are opened so as to have substantially an identical height position. In the present embodiment, the inner tank side plate piece 42P1 and the second outer tank side plate piece 22P2 are positioned at substantially the same height position. In the outer tank side plate 22, not only the lowermost outer tank side plate piece 22P1 but also the second outer tank side plate piece 22P2 are removed, whereby the height positions of the second opening OP2 and the first opening OP1 are matched.

Similarly, also regarding the intermediate tank side plate 32, the intermediate tank side plate pieces 32P3 and 32P4 constituting the third and fourth circular steps are sequentially stacked on the installed second intermediate tank side plate piece 32P2. In the present embodiment, an inner tank side plate piece 42Pn and an intermediate tank side plate piece 32Pn (excluding the piece 32P1 for height matching) have the same height width. Accordingly, the inner tank side plate pieces 42P1, 42P2, and 43P3 and the intermediate tank side plate pieces 32P2, 32P3, and 32P4 illustrated in FIG. 9 are positioned at the same height position, respectively.

A third opening OP3 is provided as a construction opening also when the intermediate tank side plate 32 is installed. The third opening OP3 is opened by pulling out one or a plurality of the intermediate tank side plate pieces 32P2 constituting the second circular step. As indicated by "open" in the chart of FIG. 2, at the time point of process S7, the second opening OP2 is opened in the inner tank side plate 42, and the third opening OP3 is opened in the intermediate tank side plate 32. Note that the first opening OP1 of the outer tank side plate 22 is opened at the time point of process S2.

The opening position of the third opening OP3 is a position corresponding to the second opening OP2 of the inner tank side plate 42. Specifically, the second opening OP2 and the third opening OP3 are opened at substantially the same position in the circumferential direction, and are opened so as to have substantially an identical height position. As described above, the second opening OP2 is opened at a position corresponding to the first opening OP1 of the outer tank side plate 22. Accordingly, the first opening OP1, the second opening OP2, and the third opening OP3 are opened at substantially identical circumferential position and height position. Therefore, it is possible to efficiently cause a worker to pass through inside and outside the tank under construction, and to materials and construction equipment to be carried in and out.

The temporary roof 431 is an iron plate member having an umbrella shape, and is temporarily attached to the outer peripheral edge 43E of the inner tank roof 43. The temporary roof 431 is a member intended to fill a gap between the outer peripheral edge 43E and the inner tank side plate 42 to some extent when executing air-raising. In addition to this, the temporary roof 431 also plays a role as a side groove through which rainwater is prevented from entering from between the outer peripheral edge 43E of the inner tank roof 43 and the inner tank side plate 42 and the rainwater is discharged toward the second opening OP2. Accordingly, in cooling work on the outer tank bottom plate 21, quality deterioration due to rainwater is suppressed.

In process S7, the first level concrete layer 24 not illustrated and the outer bottom portion cool layer 26 are sequentially laid further on the outer tank bottom plate 21. Since the part on the outer tank annular 211 of the first level concrete layer 24 has been constructed in process S2, the remaining part is constructed. As described above, the outer bottom portion cool layer 26 is installed by paving a heat insulating blocking material such as, for example, foam glass on the inside of the first ring portion 25.

<Process S8>

Figure 10:
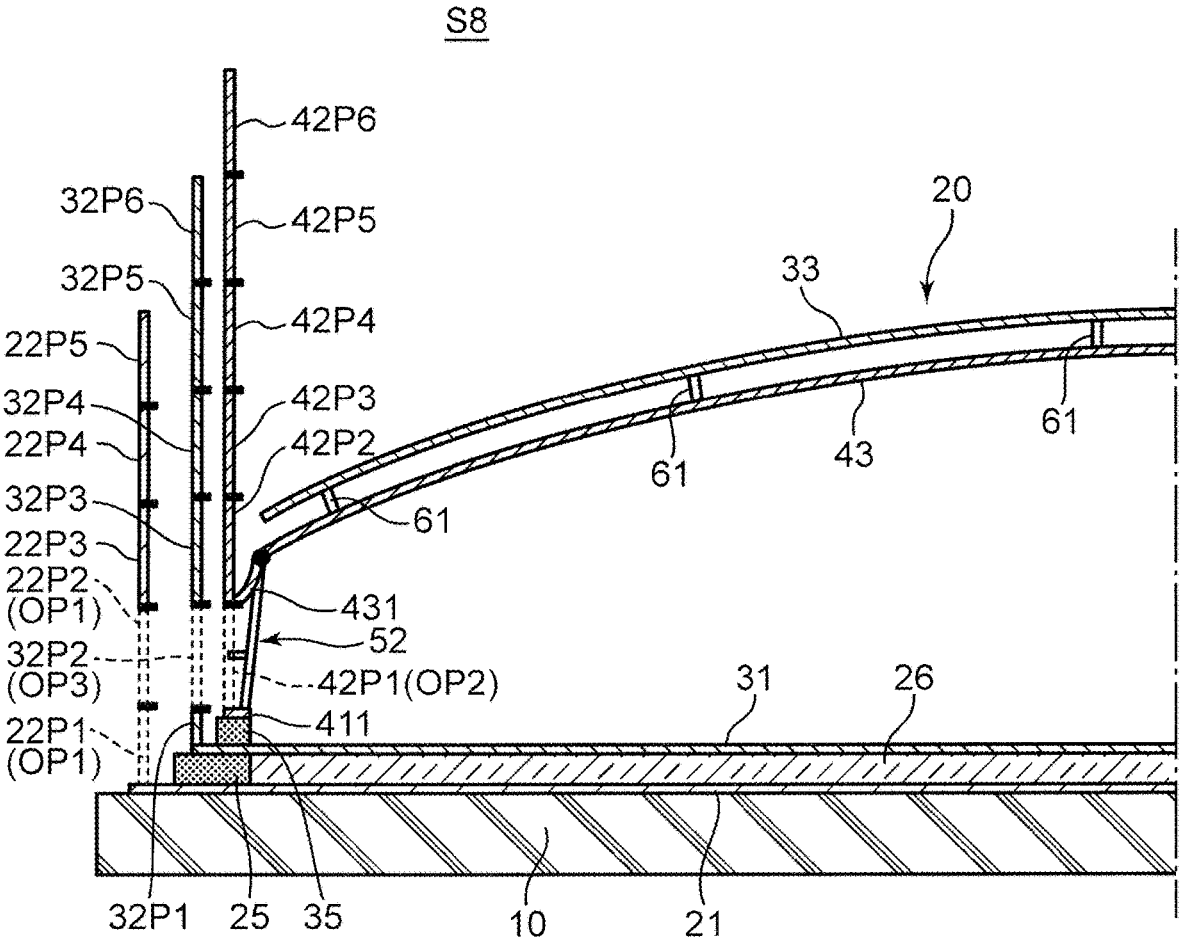
FIG. 10 is a view illustrating one process of the method for constructing the triple shell tank.

FIG. 10 illustrates a construction status in process S8. In process S8, installation of the intermediate tank roof 33, continuation of the installation of the three side plates 22, 32, and 42, and the laying of the intermediate tank bottom plate 31 are performed. Regarding the intermediate tank roof 33, the intermediate tank roof 33 having a dome shape is finally formed by connecting the intermediate tank roof block assembled in advance by ground work to the intermediate tank roof piece 33P at the radial center placed in process S6. Similarly to the inner tank roof block described above, the intermediate tank roof block includes a roof skeleton and a plurality of roof plates. During this extension, the intermediate tank roof support 61 is disposed at an appropriate location between the intermediate tank roof 33 and the inner tank roof 43, and the both are temporarily fixed. Due to completion of the intermediate tank roof 33, the connected roof body 20 in which the inner tank roof 43 and the intermediate tank roof 33 are integrated is formed by the temporary fixing of the intermediate tank roof support 61. Formation of the connected roof body 20 enables these two roofs to be integrally air-raised.

Regarding the inner tank side plate 42, inner tank side plate pieces 42P5 and 42P6 constituting fifth and sixth circular steps are installed on the inner tank side plate piece 42P4 constituting the fourth circular step. Regarding the intermediate tank side plate 32, intermediate tank side plate pieces 32P5 and 32P6 constituting the fifth and sixth circular steps are installed on the intermediate tank side plate pieces 32P4 constituting the fourth circular step. Regarding the outer tank side plate 22, outer tank side plate pieces 22P4 and 22P5 constituting fourth and fifth circular steps are sequentially installed on the third outer tank side plate piece 22P3.

In this manner, in the present embodiment, the circular step of the inner tank side plate 42, the circular step of the intermediate tank side plate 32, and the circular step of the outer tank side plate 22 are stacked in parallel. Moreover, the three side plates 22, 32, and 42 are formed simultaneously with the formation of the connected roof body 20. In the inner tank AR method, the inner tank side plate 42 serves as a guide side plate during air-raising, and the connected roof body 20 is assembled inside the inner tank side plate 42. Therefore, the intermediate tank side plate 32 and the outer tank side plate 22 disposed outside the inner tank side plate 42 can be installed without being limited to the installation work of the connected roof body 20 performed in ground work. Accordingly, the installation work of the intermediate tank side plate 32 and the outer tank side plate 22 can be performed in parallel with the installation work of the inner tank side plate 42, that is, the three side plates 22, 32, and 42 can be installed simultaneously in parallel. Adoption of such a construction method can achieve improvement of work efficiency such as sharing a scaffold, for example, in installation of the three side plates 22, 32, and 42, and can eventually contribute to shortening of the construction period.

Furthermore, in process S8, the remaining part of the intermediate tank bottom plate 31 is laid on the outer bottom portion cool layer 26. Regarding the intermediate tank bottom plate 31, since the intermediate tank annular 311 constituting the outer periphery portion has been installed, the intermediate tank bottom plate 31 of the inner part is laid.

<Process S9>

Figure 11:
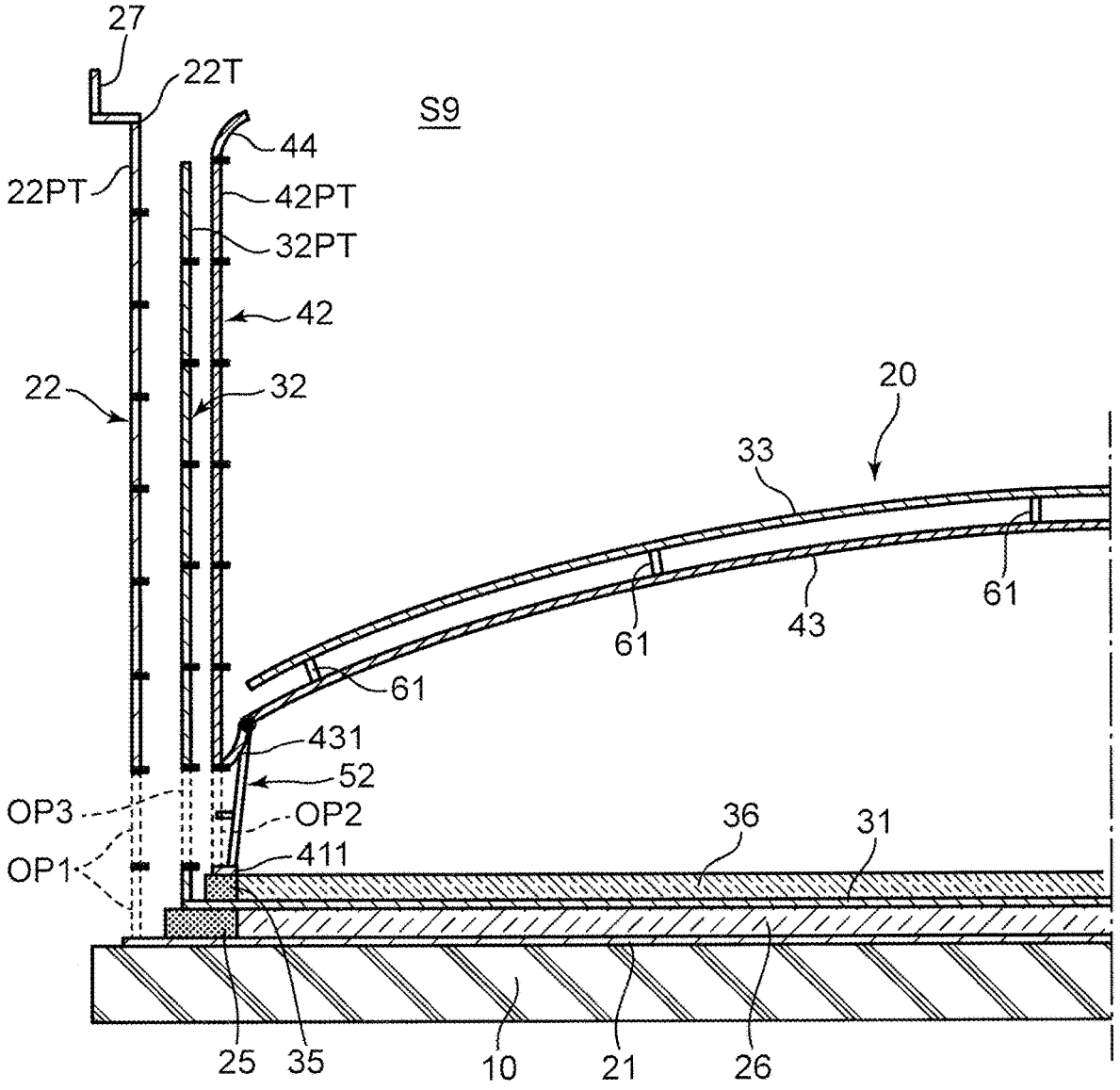
FIG. 11 is a view illustrating one process of the method for constructing the triple shell tank.

FIG. 11 illustrates a construction status in process S9. In process S9, upper parts of the three side plates 22, 32, and 42 are installed. FIG. 11 illustrates a state in which installation of an inner tank side plate piece 42PT constituting an uppermost circular step is completed regarding the inner tank side plate 42. Also regarding the intermediate tank side plate 32, a state in which installation of an intermediate tank side plate piece 32PT constituting the uppermost circular step is completed. An inner tank knuckle plate 44 is installed on the inner tank side plate piece 42PT. The inner tank knuckle plate 44 is a plate connecting the inner tank side plate 42 and the outer periphery ring 43R of the outer peripheral edge of the inner tank roof 43, and is a piece substantially constituting the uppermost step of the inner tank side plate 42 in the present embodiment.

In processes S8 and S9, it is desirable to stack the circular steps of the inner tank side plate 42 prior to the stacking of the circular steps of the intermediate tank side plate 32. For example, after the second inner tank side plate piece 42P2 of the inner tank side plate 42 is stacked, the third intermediate tank side plate piece 32P3 of the intermediate tank side plate 32 is stacked, and subsequently the third inner tank side plate piece 42P3 of the inner tank side plate 42 is stacked. Adoption of such installation method can achieve improvement of work efficiency such as sharing a scaffold in installation of the inner tank side plate 42 and the intermediate tank side plate 32.

Also for convenience of crane lifting work and assembling work of the side plate pieces, it is desirable that stacking of the inner tank side plate pieces 42Pn positioned on the radially inner side precede stacking of the intermediate tank side plate pieces 32Pn. That is, at the time of lifting the side plate pieces 32Pn and 42Pn, "outer lifting" in which the crane is disposed on the radially outer side of the side plate to perform the lifting is performed. This is in consideration that both the inner tank side plate 42 and the intermediate tank side plate 32 have an assembly jig including a scaffold on the inner face side, and the worker has access to the inner face side. If the intermediate tank side plate 32 is assembled first, presence of an inner face scaffold of the intermediate tank side plate 32 makes it difficult to lift the inner tank side plate piece 42Pn. Therefore, it is desirable to assemble the inner tank side plate 42 first, form the scaffold on the inner side of the intermediate tank side plate 32, and then lift up the intermediate tank side plate piece 32Pn from the outer side.

Also regarding the outer tank side plate 22, stacking in circular steps is performed, and installation is completed by installing an outer tank side plate pieces 22PT constituting the uppermost circular step. An outer periphery corridor 27 is installed on a top part 22T of the outer tank side plate 22.

In process S9, the second level concrete layer 34 not illustrated in FIG. 11 and the inner bottom portion cool layer 36 are sequentially laid further on the intermediate tank bottom plate 31. The inner bottom portion cool layer 36 is installed by paving a heat insulating blocking material such as, for example, foam glass on the inside of the second ring portion 35.

<Process S10>

Figure 12:
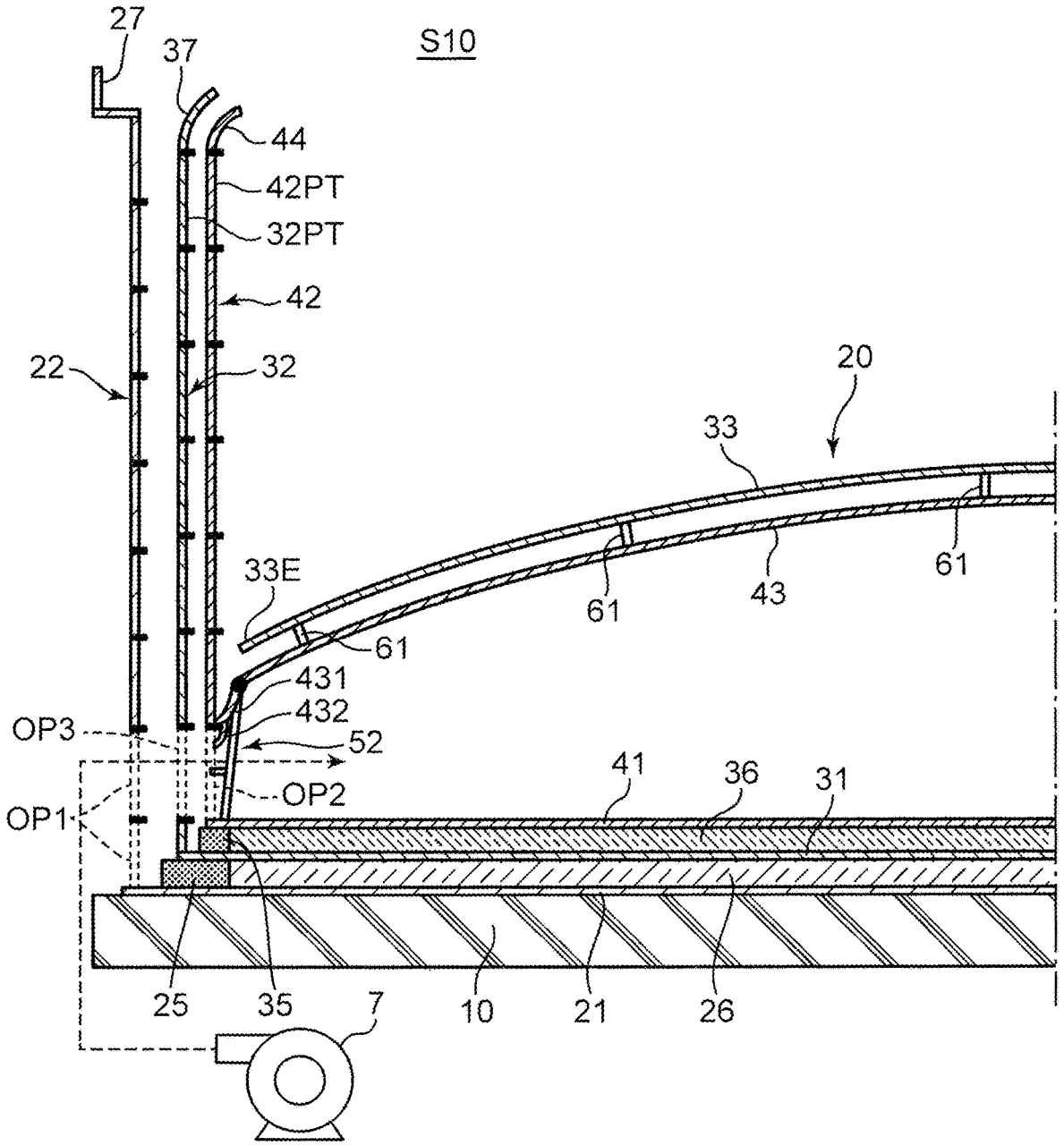
FIG. 12 is a view illustrating one process of the method for constructing the triple shell tank.

FIG. 12 illustrates a construction status in process S10. In process S10, preparation work for air-raising is mainly performed. In the inner tank AR method, it is necessary to seal a region surrounded by the inner tank side plate 42 and the inner tank roof 43. In order to seal a bottom part of this region, the inner tank bottom plate 41 is installed before air-raising. The inner tank bottom plate 41 is laid on the inner bottom portion cool layer 36. Regarding the inner tank bottom plate 41, since the inner tank annular 411 constituting the outer periphery portion has been installed, the inner tank bottom plate 41 of the inner part is laid.

A sealing process between the inner tank side plate 42 and the inner tank roof 43 is also performed. The temporary roof 431 attached to the outer peripheral edge 43E of the inner tank roof 43 is mounted with a sealing material 432. The sealing material 432 seals a gap between the temporary roof 431 and the inner face of the inner tank side plate 42. On the outer side of the outer tank side plate 22, a blower 7 that supplies air for air-raising is prepared. A blowing duct is connected to an air delivery port of the blower 7, and this blowing duct is drawn into the inner side of the inner tank side plate 42 through the first opening OP1, the third opening OP3, and the second opening OP2. Note that the second opening OP2 is also subjected to a sealing process for temporarily sealing around the blowing duct. At this time point, the space surrounded by the inner tank bottom plate 41, the inner tank side plate 42, and the inner tank roof 43 is sealed.

An intermediate tank knuckle plate 37 is installed on the intermediate tank side plate piece 32PT constituting the uppermost circular step of the intermediate tank side plate 32. The intermediate tank knuckle plate 37 is a plate connecting the upper end of the intermediate tank side plate 32 and an outer peripheral edge 33E of the intermediate tank roof 33.

<Process S11>

Figure 13:
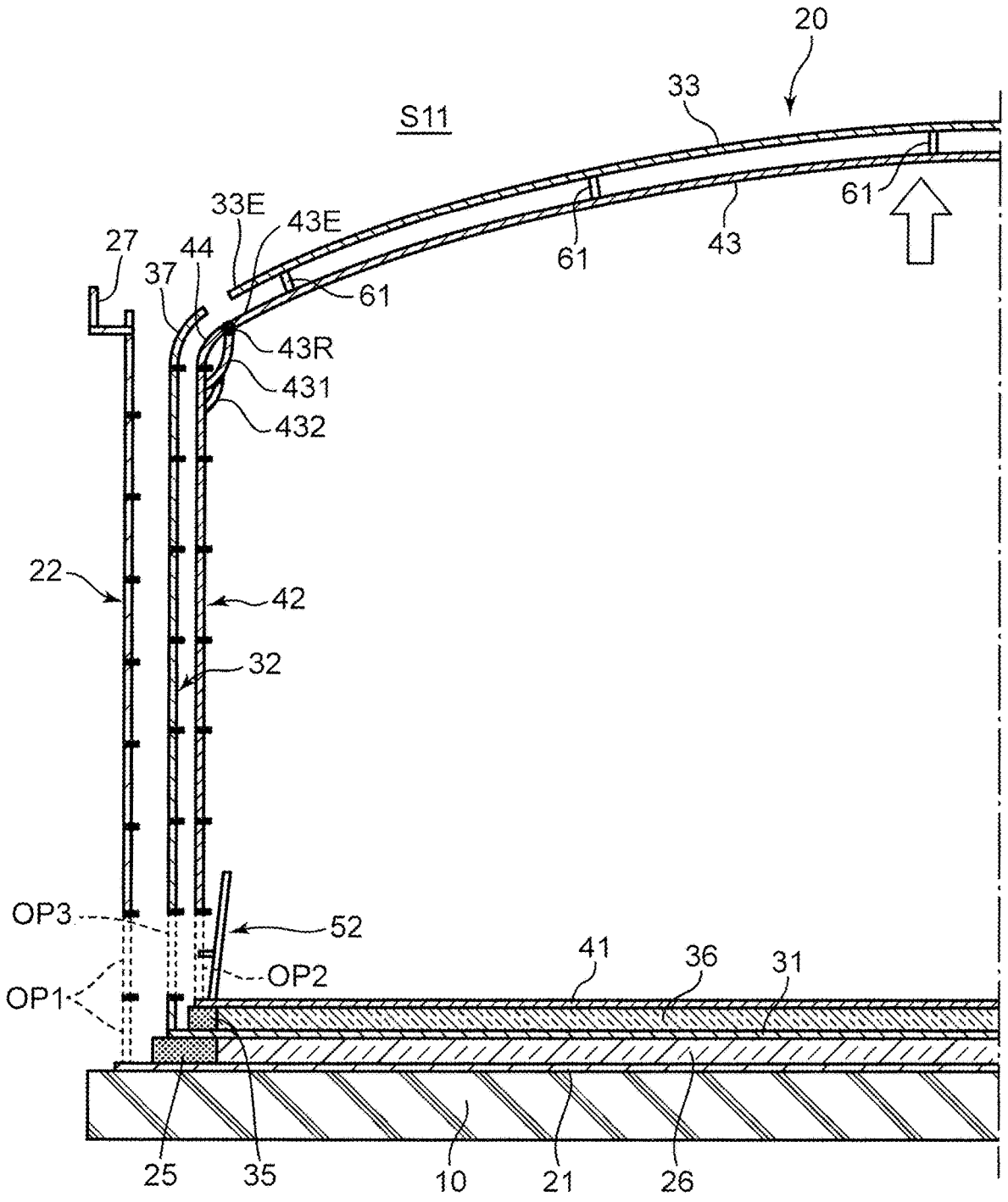
FIG. 13 is a view illustrating one process of the method for constructing the triple shell tank.

FIG. 13 illustrates a status in process S11 corresponding to a state after performing of air-raising. In executing air-raising, the blower 7 illustrated in FIG. 12 is operated, and air is supplied to the sealed space surrounded by the inner tank bottom plate 41, the inner tank side plate 42, and the inner tank roof 43. Air pressure in the sealed space is increased by air supply, and the connected roof body 20 is floated by the pressure. At this time, the inner tank side plate 42 plays a role as a guide of the floating connected roof body 20.

What is directly air-raised is the inner tank roof 43. However, the intermediate tank roof 33 is also integrally floated in an aspect of being supported from below by the inner tank roof 43 via the intermediate tank roof support 61. That is, since the connected roof body 20 is formed in advance, the inner tank roof 43 and the intermediate tank roof 33, which are not originally connected, can be floated at once by one time of air-raising. Note that at the time of air-raising, the floating attitude of the connected roof body 20 is controlled using a balance wire.

After the air-raising, the inner tank roof 43 and the inner tank side plate 42 are fixed. Specifically, the outer periphery ring 43R of the inner tank roof 43 is fixed to the inner tank knuckle plate 44 at the uppermost part of the inner tank side plate 42. At this time point, the temporary fixing of the connected roof body 20 is not released, and the inner tank roof 43 and the intermediate tank roof 33 remain in a state of being temporarily fixed by the intermediate tank roof support 61. Equipment for air-raising is removed. That is, the temporary roof 431 and the sealing material 432 attached to the vicinity of the outer peripheral edge 43E of the inner tank roof 43 are detached, and the blower 7 and the air blowing duct are removed. The temporary sealing of the openings OP1, OP2, and OP3 is also removed.

<Process S12>

Figure 14:
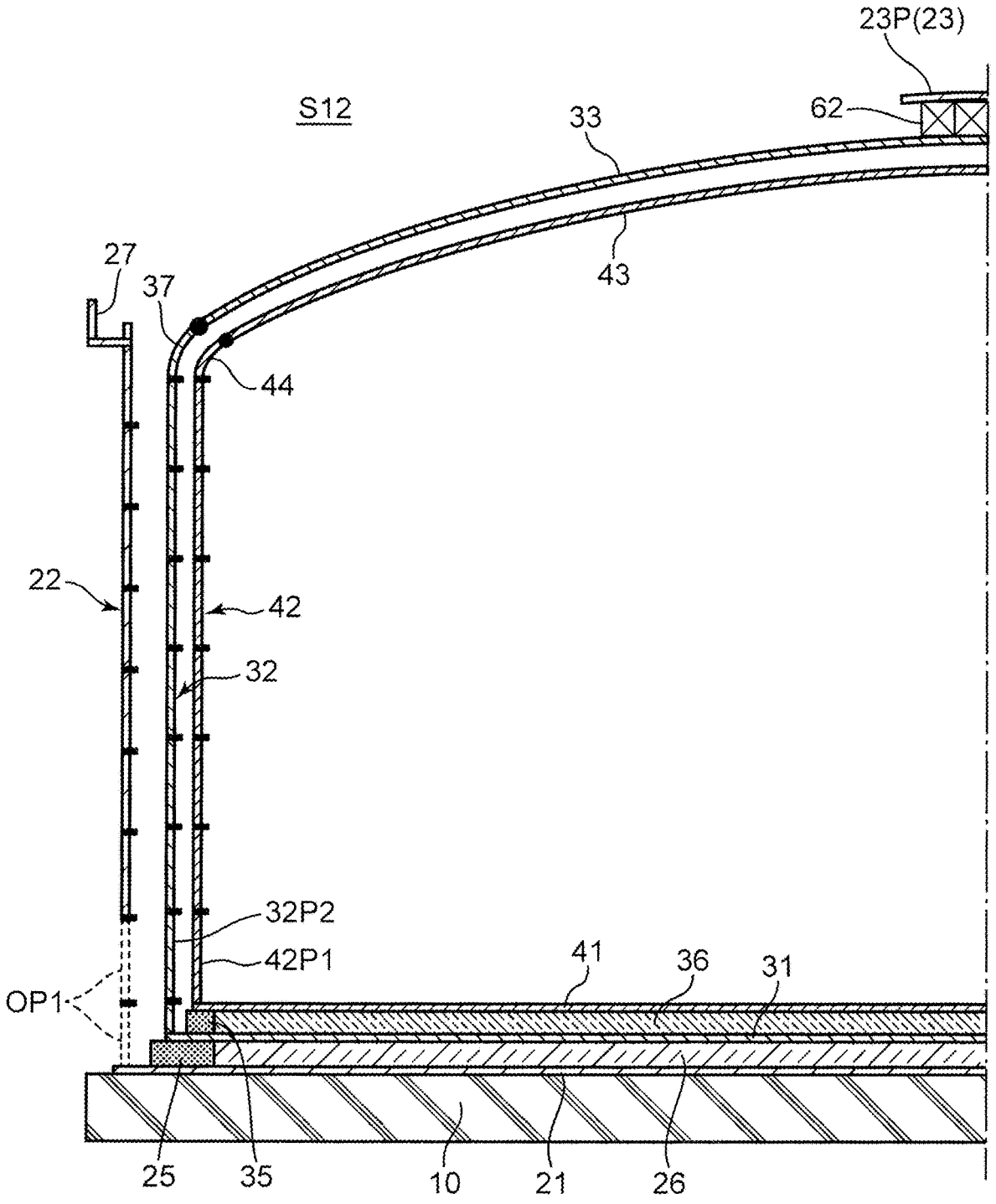
FIG. 14 is a view illustrating one process of the method for constructing the triple shell tank.

FIG. 14 illustrates a construction status in process S12. In process S12, the installation of the intermediate tank roof 33 is continued, and installation of the outer tank roof 23 is started. Regarding the intermediate tank roof 33, the upper end of the intermediate tank knuckle plate 37 and the outer peripheral edge of the intermediate tank roof 33 are fixed. At the time of this fixing work, the intermediate tank roof support 61 is detached, and the temporary fixing of the connected roof body 20 is released.

Installation of the outer tank roof 23 is started from this process. That is, a method of assembling the outer tank roof 23 on the connected roof body 20 after air-raising, and then fixing the outer tank roof 23 and the outer tank side plate 22 is adopted. Adoption of this method enables the outer tank 2 to be efficiently installed. Specifically, an outer tank roof center support 62 (temporary support) is placed at the radial center of the intermediate tank roof 33. FIG. 14 illustrates a state in which an outer tank roof piece 23P constituting the vicinity of the radial center of the outer tank roof 23 is installed on the outer tank roof center support 62.

In process S12, as indicated by "close" in the chart of FIG. 2, the second opening OP2 of the inner tank side plate 42 and the third opening OP3 of the intermediate tank side plate 32 are sealed. The second opening OP2 is sealed after the work inside the inner tank 4 is completed and the scaffold or the like placed inside the inner tank 4 is removed. In this sealing work, the inner tank side plate piece 42P1 pulled out in process S7 is fitted into the second opening OP2, and the inner tank side plate piece 42P1 is welded to a surrounding side plate piece. Similarly, the third opening OP3 is sealed after the work inside the intermediate tank 3 is completed and the scaffold or the like placed inside the intermediate tank 3 is removed. At the time of this sealing, the pulled out intermediate tank side plate piece 32P2 is fitted into the third opening OP3, and the intermediate tank side plate piece 32P2 is welded to a surrounding side plate piece.

<Process S13>

Figure 15:
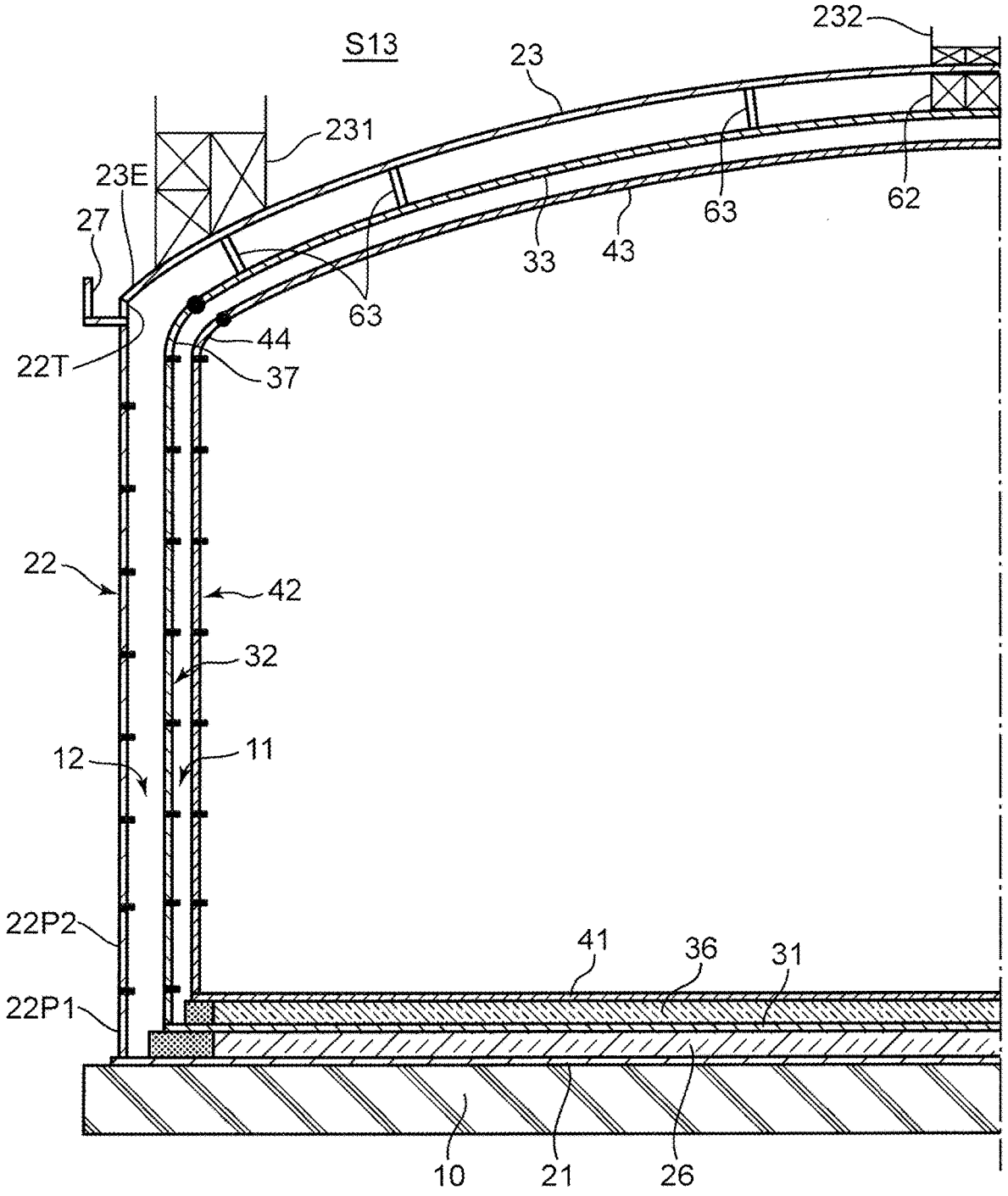
FIG. 15 is a view illustrating one process of the method for constructing the triple shell tank.

FIG. 15 illustrates a construction status in process S13. In process S13, installation of the outer tank roof 23, sealing of the first opening OP1, installation of the deck, and the like are performed. Regarding the outer tank roof 23, the outer tank roof 23 having a dome shape is finally formed by connecting the outer tank roof block assembled in advance by ground work to the outer tank roof piece 23P at the radial center placed in process S13. During this extension, an outer tank roof periphery support 63 (temporary support) made of H steel or the like is disposed at an appropriate location between the intermediate tank roof 33 and the outer tank roof 23. Thereafter, an outer peripheral edge 23E of the outer tank roof 23 is fixed to the top part 22T of the outer tank side plate 22.

A shoulder part deck 231 and a top part deck 232 are installed on the outer tank roof 23. The shoulder part deck 231 is disposed on a radially outer periphery part of the outer tank roof 23. The top part deck 232 is disposed at the radial center of the outer tank roof 23. Note that the work of filling the first inter-vessel 11 and the second inter-vessel 12 with a heat insulation material, the work of attaching various pipes and accessories, and the like are also performed.

After the work inside the outer tank 2 is completed and the scaffold and the like placed inside the outer tank 2 are removed, the first opening OP1 of the outer tank side plate 22 is sealed. In this sealing work, the outer tank side plate pieces 22P1 and 22P2 pulled out in processes S2 and S4 are fitted so as to close the first opening OP1, and are welded. As described above, the construction openings are sequentially sealed upon completing the work in each side plate in the order of the inner second opening OP2, the intermediate third opening OP3, and the outer first opening OP1.

Second Embodiment; Intermediate Vessel AR Method

Figure 16:
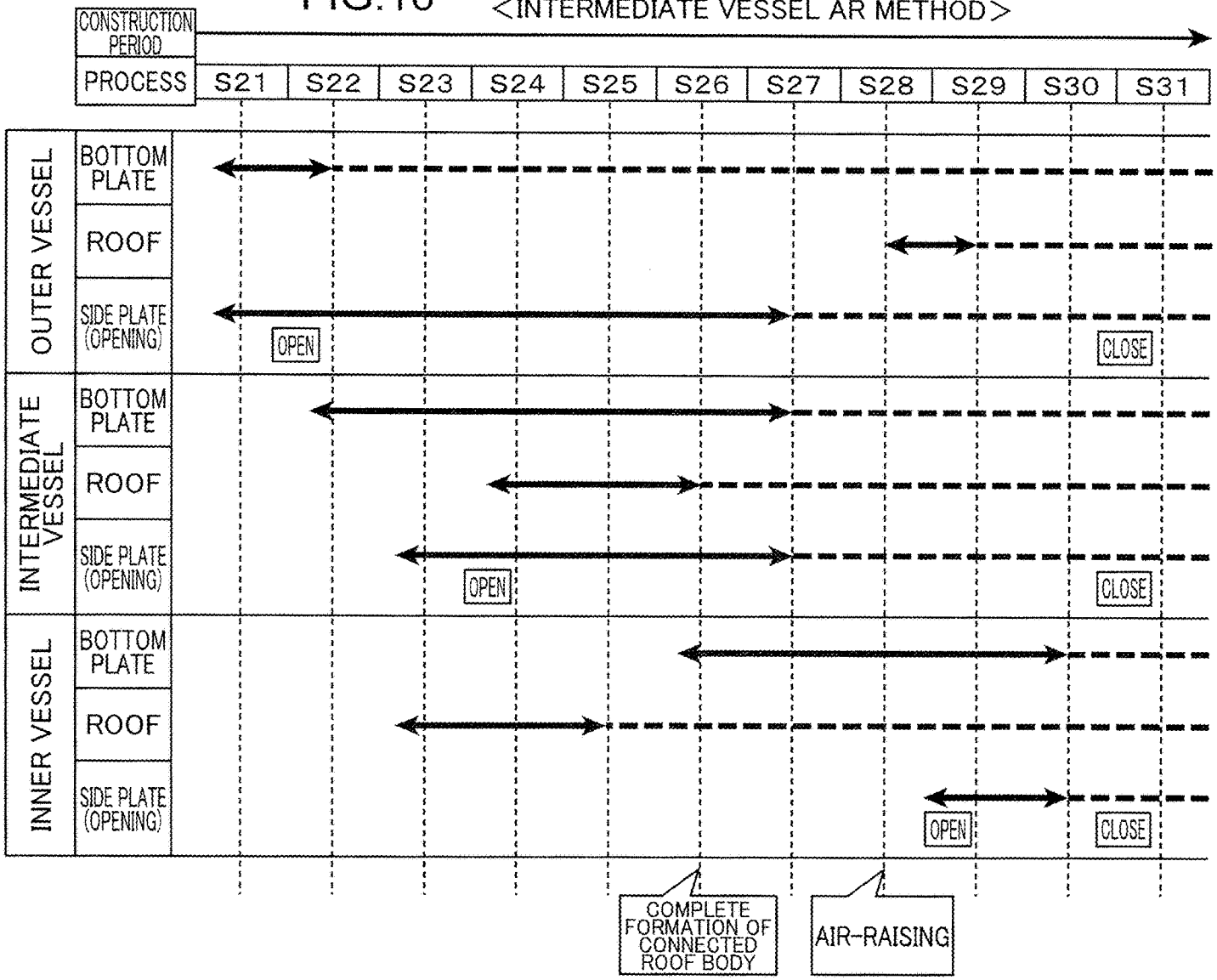
FIG. 16 is a process chart of a method for constructing a triple shell tank according to a second embodiment (intermediate tank AR method) of the present disclosure.

FIG. 16 is a process chart showing one embodiment of a method for constructing the triple shell tank 1 according to the second embodiment. Similarly to FIG. 2, FIG. 16 shows the relationship between processes S21 to S31 performed during the construction period of the triple shell tank 1 and the construction time of each part of the triple shell tank 1. As also shown in FIG. 16, a characteristic point of the construction method of the second embodiment lies in, similarly to the first embodiment, forming, by ground work (process S26), a connected roof body formed by temporarily fixing the intermediate tank roof 33 and the inner tank roof 43, and floating (process S28) the connected roof body by air-raising. FIGS. 17 to 24 are views schematically illustrating construction states of the triple shell tank 1 in processes S24 to S31 shown in FIG. 16, respectively. Note that description will be omitted or simplified regarding construction parts similar to those of the first embodiment.

<Processes S21, S22, and S23>

In processes S21, S22, and S23, laying of the outer tank bottom plate 21, installation of the lower parts of the outer tank side plate 22 and the intermediate tank side plate 32, installation of the center roof support 51 and the inner tank roof piece 43P, and the like are performed. The first opening OP1 is opened in the outer tank side plate 22. These processes S21, S22, and S23 are the same as processes S1, S2, and S3 described in FIGS. 3, 4, and 5, respectively, in the first embodiment described above, and thus the description of each process is omitted.

<Process S24>

Figure 17:
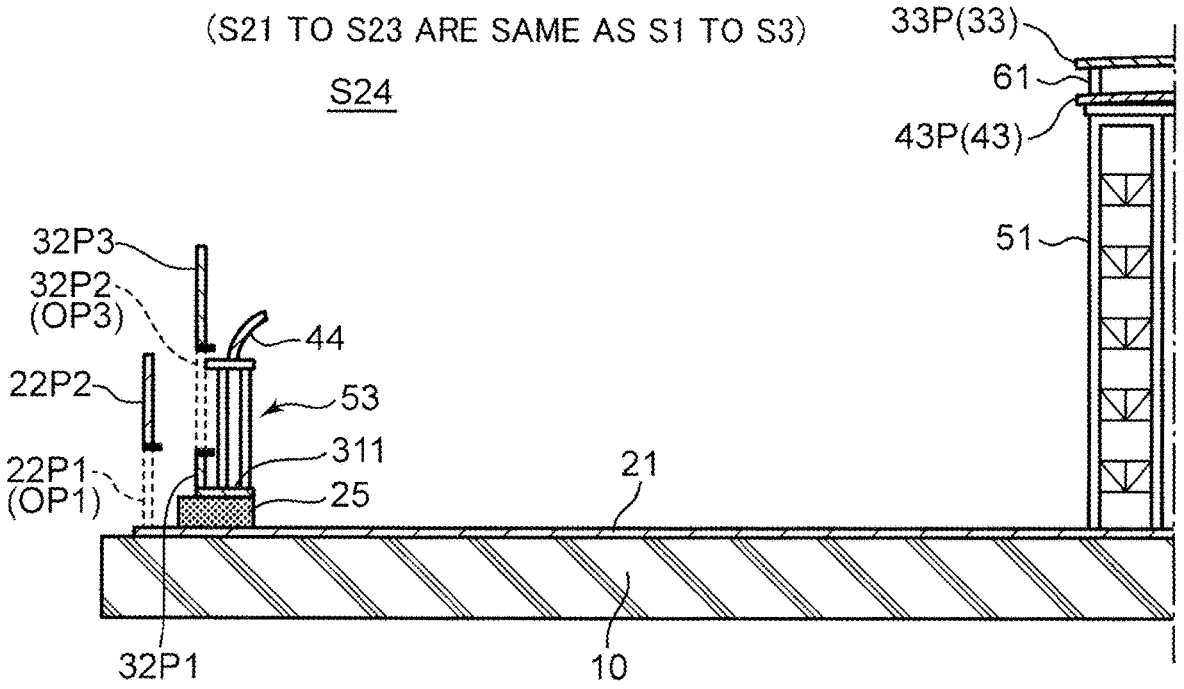
FIG. 17 is a view illustrating, with a cross section of half of the tank, one process of the method for constructing the triple shell tank according to the second embodiment.

FIG. 17 illustrates a construction status in process S24. In process S24, the construction of the intermediate tank side plate 32 is continued, and installation of the intermediate tank roof 33 is started. The latter is also the beginning of formation of the connected roof body. Regarding the intermediate tank side plate 32, the intermediate tank side plate piece 32P3 constituting the third circular step is stacked on the installed second intermediate tank side plate piece 32P2. At this time point, the intermediate tank side plate 32 is provided with the third opening OP3 as a construction opening. Note that in the intermediate tank AR method, since the intermediate tank side plate 32 serves as a guide side plate at the time of air-raising, installation of the inner tank side plate 42 is after air-raising. Regarding the intermediate tank roof 33, an intermediate tank roof piece 33P constituting the vicinity of the radial center of the intermediate tank roof 33 is installed on the inner tank roof piece 43P previously installed on the center roof support 51. In this installation, an intermediate tank roof support 61 is used.

In addition to this, in process S24, an outer periphery roof support 53 is placed. The outer periphery roof support 53 is a frame temporarily supporting the outer peripheral lower edge of the inner tank roof 43. The outer periphery roof support 53 is a frame erected on the upper surface of the intermediate tank annular 311. The upper end of the outer periphery roof support 52 is attached with the inner tank knuckle plate 44 that connects the inner tank side plate 42 and the inner tank roof 43.

<Process S25>

Figure 18:
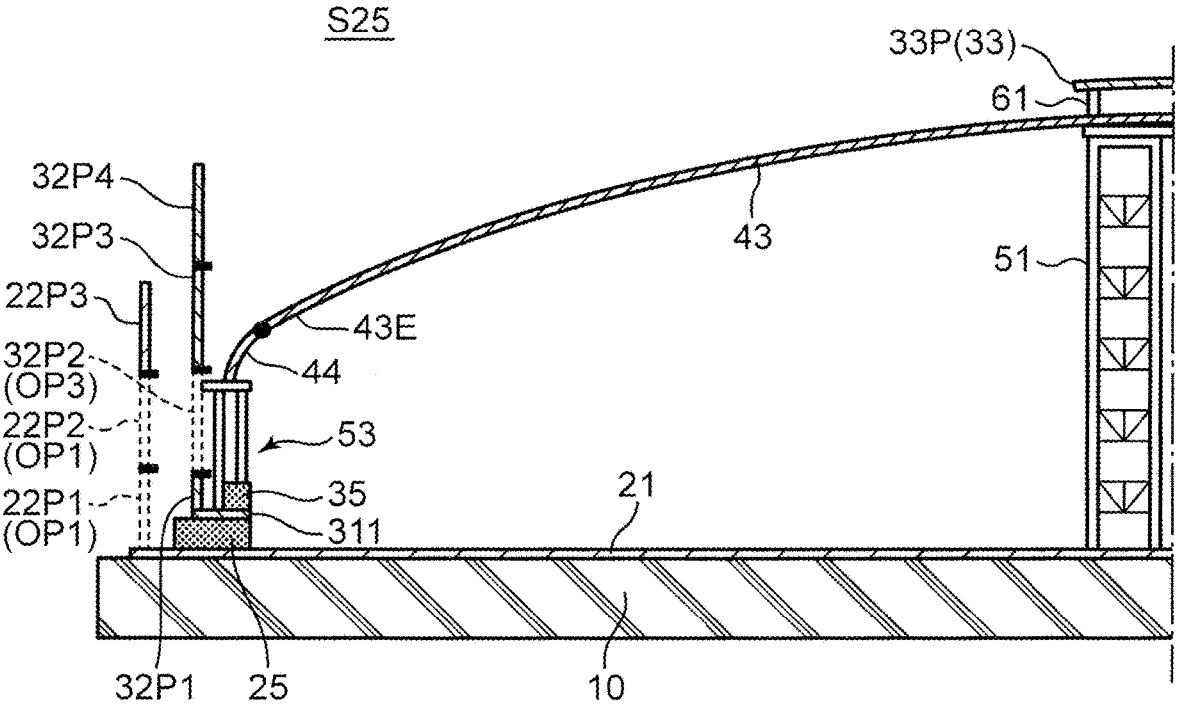
FIG. 18 is a view illustrating one process of the method for constructing the triple shell tank.

FIG. 18 illustrates a construction status in process S25. In process S25, the installation of the inner tank roof 43, the intermediate tank side plate 32, and the outer tank side plate 22 is continued. Regarding the inner tank roof 43, the inner tank roof 43 having a dome shape is formed by connecting between the inner tank roof piece 43P on the center roof support 51 and the inner tank knuckle plate 44 with an inner tank roof block assembled in advance by ground work. The outer peripheral edge 43E of the inner tank roof 43 is fixed to the inner tank knuckle plate 44 supported by the outer periphery roof support 52.

Regarding the intermediate tank side plate 32, the intermediate tank side plate piece 32P4 constituting the fourth circular step is installed on the third intermediate tank side plate piece 32P3. Regarding the outer tank side plate 22, an outer tank side plate piece 22P3 constituting a third circular step is installed on the outer tank side plate piece 22P2 constituting the second circular step. Similarly to the first embodiment, after installation of the third circular step, one or a plurality of the outer tank side plate pieces 22P2 in the second circular step are pulled out, thereby opening the first opening OP1, which becomes a construction opening. Due to this, the first opening OP1 is opened in the outer tank side plate 22 at a height corresponding to two circular steps.

<Process S26>

Figure 19:
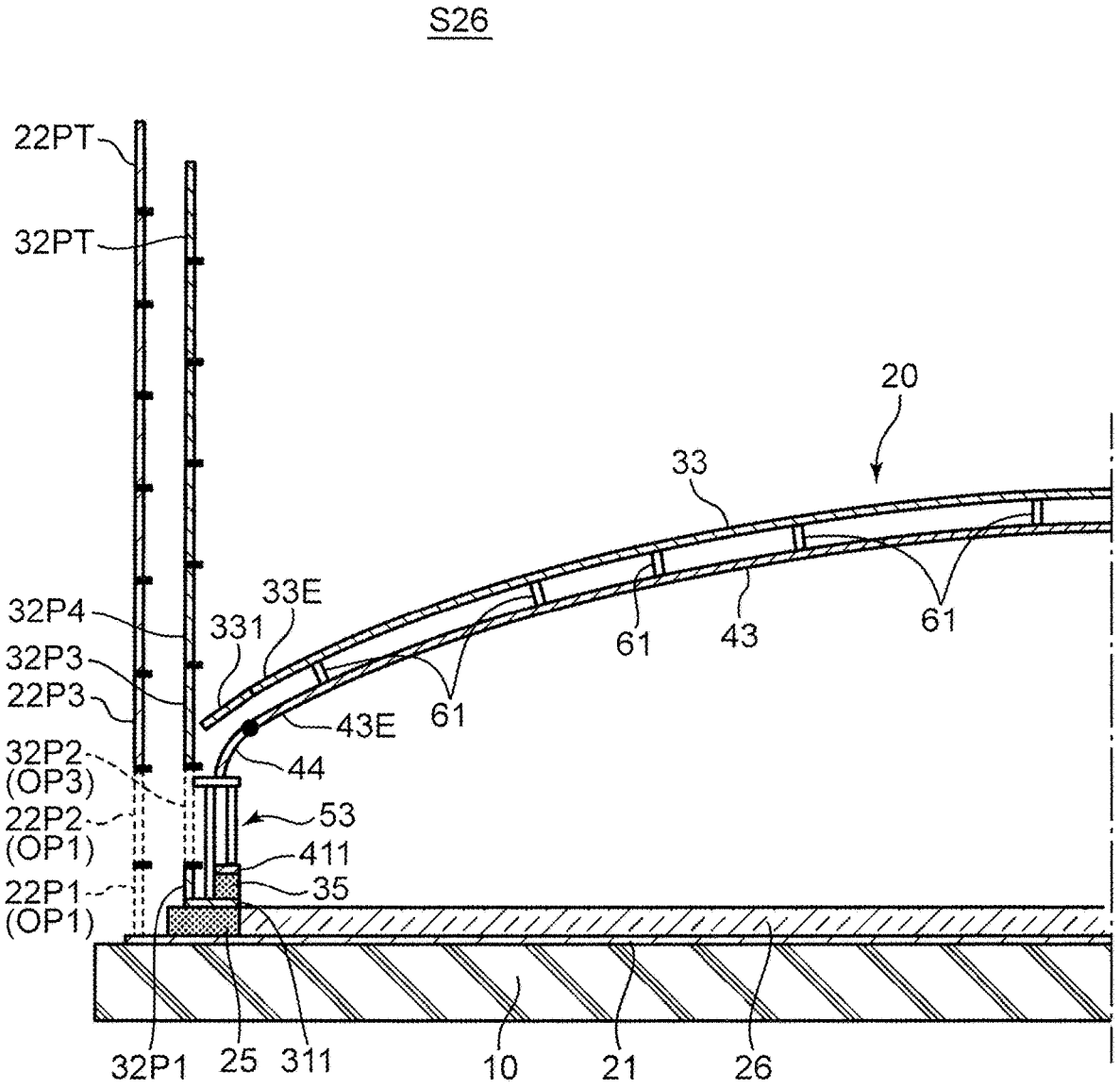
FIG. 19 is a view illustrating one process of the method for constructing the triple shell tank.

FIG. 19 illustrates a construction status in process S26. In process S26, the installation of the intermediate tank roof 33, the intermediate tank side plate 32, and the outer tank side plate 22 is continued. Regarding the intermediate tank roof 33, the intermediate tank roof 33 having a dome shape is finally formed by connecting the intermediate tank roof block assembled in advance by ground work to the intermediate tank roof piece 33P at the radial center placed previously. During this extension, the intermediate tank roof support 61 is disposed at an appropriate location between the intermediate tank roof 33 and the inner tank roof 43. Due to this, the connected roof body 20 in which the inner tank roof 43 and the intermediate tank roof 33 are temporarily fixed is formed. Formation of the connected roof body 20 enables these two roofs to be integrally air-raised.

Regarding the intermediate tank side plate 32, a side plate piece constituting a further upper circular step is installed on the intermediate tank side plate piece 32P4 constituting the fourth circular step. Similarly, also regarding the outer tank side plate 22, a side plate piece constituting a further upper circular step is installed on the third outer tank side plate piece 22P3. FIG. 19 illustrates a state in which installation of the intermediate tank side plate piece 32PT and the outer tank side plate piece 22PT constituting the uppermost circular step is completed. In the case of the second embodiment in which the intermediate tank roof 33 is a direct air-raising target, the outer tank side plate 22 disposed outside the intermediate tank side plate 32 can be installed without being limited to the installation work of the connected roof body 20 performed in ground work. Accordingly, as illustrated in FIGS. 18 and 19, it is desirable to stack the circular step of the outer tank side plate 22 and the circular step of the intermediate tank side plate 32 in parallel. This can achieve improvement of work efficiency such as sharing a scaffold, for example, in installation of the outer tank side plate 22 and the intermediate tank side plate 32, and can eventually contribute to shortening of the construction period.

In addition to these, in process S26, the intermediate tank roof 33 is attached with a temporary roof 331. The temporary roof 331 is an iron plate member having an umbrella shape, and is temporarily attached to the outer peripheral edge 33E of the intermediate tank roof 33. The temporary roof 331 is a member intended to fill a gap between the outer peripheral edge 33E and the intermediate tank side plate 32 to some extent when executing air-raising of the intermediate tank roof 33. The outer bottom portion cool layer 26 is laid on the outer tank bottom plate 21. Furthermore, the inner tank annular 411 is installed on the upper surface of the second ring portion 35. The temporary roof 331 also plays a role as a side groove through which rainwater is prevented from entering from between the outer peripheral edge 33E of the intermediate tank roof 33 and the intermediate tank side plate 32 and the rainwater is discharged toward the third opening OP3. Due to this, in cooling work on the outer tank bottom plate 21, quality deterioration due to rainwater is suppressed.

<Process S27>

Figure 20:
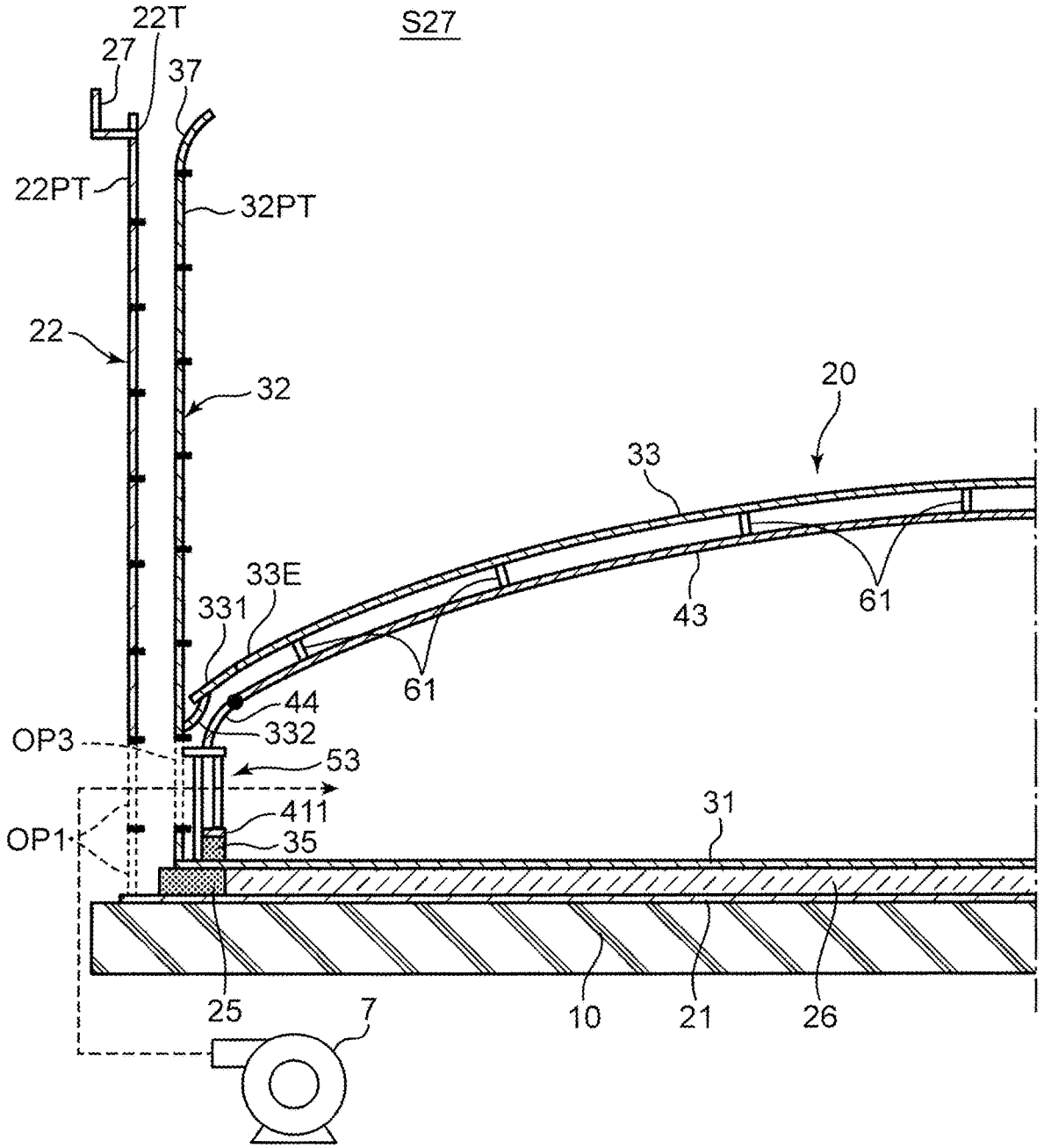
FIG. 20 is a view illustrating one process of the method for constructing the triple shell tank.

FIG. 20 illustrates a construction status in process S27. In process S27, preparation work for air-raising is mainly performed. In the intermediate tank AR method, it is necessary to seal a region surrounded by the intermediate tank side plate 32 and the intermediate tank roof 33. In order to seal a bottom part of this region, the intermediate tank bottom plate 31 is installed before air-raising. The intermediate tank bottom plate 31 is laid on the outer bottom portion cool layer 26. Regarding the intermediate tank bottom plate 31, since the intermediate tank annular 311 constituting the outer periphery portion has been installed, the intermediate tank bottom plate 31 of the inner part is laid.

A sealing process between the intermediate tank side plate 32 and the intermediate tank roof 33 is also performed. The temporary roof 331 attached to the outer peripheral edge 33E of the intermediate tank roof 33 is mounted with a sealing material 332. The sealing material 332 seals a gap between the temporary roof 331 and the inner face of the intermediate tank side plate 32. On the outer side of the outer tank side plate 22, a blower 7 that supplies air for air-raising is prepared. A blowing duct is connected to an air delivery port of the blower 7, and this blowing duct is drawn into the inner side of the intermediate tank side plate 32 through the first opening OP1 and the third opening OP3. Note that the third opening OP3 is also subjected to a sealing process for temporarily sealing around the blowing duct. At this time point, the space surrounded by the intermediate tank bottom plate 31, the intermediate tank side plate 32, and the intermediate tank roof 33 is sealed.

An intermediate tank knuckle plate 37 is installed on the intermediate tank side plate piece 32PT constituting the uppermost circular step of the intermediate tank side plate 32. The intermediate tank knuckle plate 37 is a plate connecting the outer peripheral edge 33E of the intermediate tank side plate 32 and the outer peripheral edge 33E of the intermediate tank roof 33. The outer periphery corridor 27 is installed on the top part 22T of the outer tank side plate 22.

<Process S28>

Figure 21:
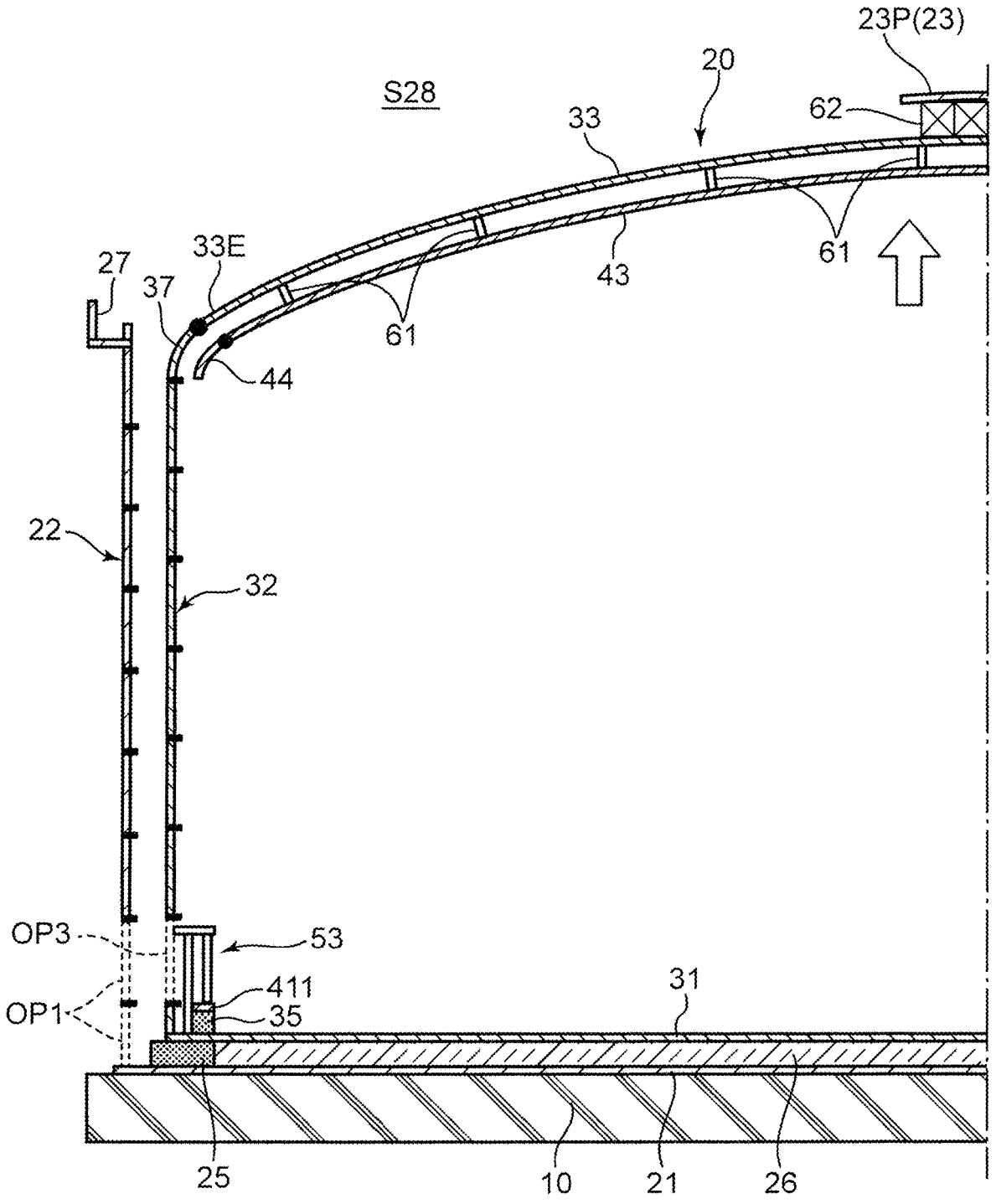
FIG. 21 is a view illustrating one process of the method for constructing the triple shell tank.

FIG. 21 illustrates a status in process S28 corresponding to a state after performing of air-raising. In executing air-raising, the blower 7 illustrated in FIG. 20 is operated, and air is supplied to the sealed space surrounded by the intermediate tank bottom plate 31, the intermediate tank side plate 32, and the intermediate tank roof 33. Air pressure in the sealed space is increased by air supply, and the connected roof body 20 is floated by the pressure. At this time, the intermediate tank side plate 32 plays a role as a guide of the floating connected roof body 20.

What is directly air-raised is the intermediate tank roof 33. However, the inner tank roof 43 is also integrally floated in an aspect of being suspended from the intermediate tank roof 33 by the intermediate tank roof support 61. That is, since the connected roof body 20 is formed in advance, the inner tank roof 43 and the intermediate tank roof 33, which are not originally connected, can be floated at once by one time of air-raising. Note that at the time of air-raising, the floating attitude of the connected roof body 20 is controlled using a balance wire.

After the air-raising, the intermediate tank roof 33 and the intermediate tank side plate 32 are fixed. Specifically, the outer peripheral edge 33E of the intermediate tank roof 33 is fixed to the upper end of the intermediate tank knuckle plate 37. At this time point, the temporary fixing of the connected roof body 20 is not released, and the inner tank roof 43 and the intermediate tank roof 33 remain in a state of being temporarily fixed by the intermediate tank roof support 61. Note that the equipment for air-raising is removed. That is, the temporary roof 331 and the sealing material 332 attached to the vicinity of the outer peripheral edge 33E are detached, and the outer periphery roof support 53, the blower 7, and the air blowing duct are removed.

Installation of the outer tank roof 23 is started from this process. That is, the outer tank roof 23 is assembled on the connected roof body 20 after air-raising, and then the outer tank roof 23 and the outer tank side plate 22 are fixed. Specifically, an outer tank roof center support 62 (temporary support) is placed at the radial center of the intermediate tank roof 33. FIG. 21 illustrates a state in which the outer tank roof piece 23P constituting the vicinity of the radial center of the outer tank roof 23 is installed on the outer tank roof center support 62.

<Process S29>

Figure 22:
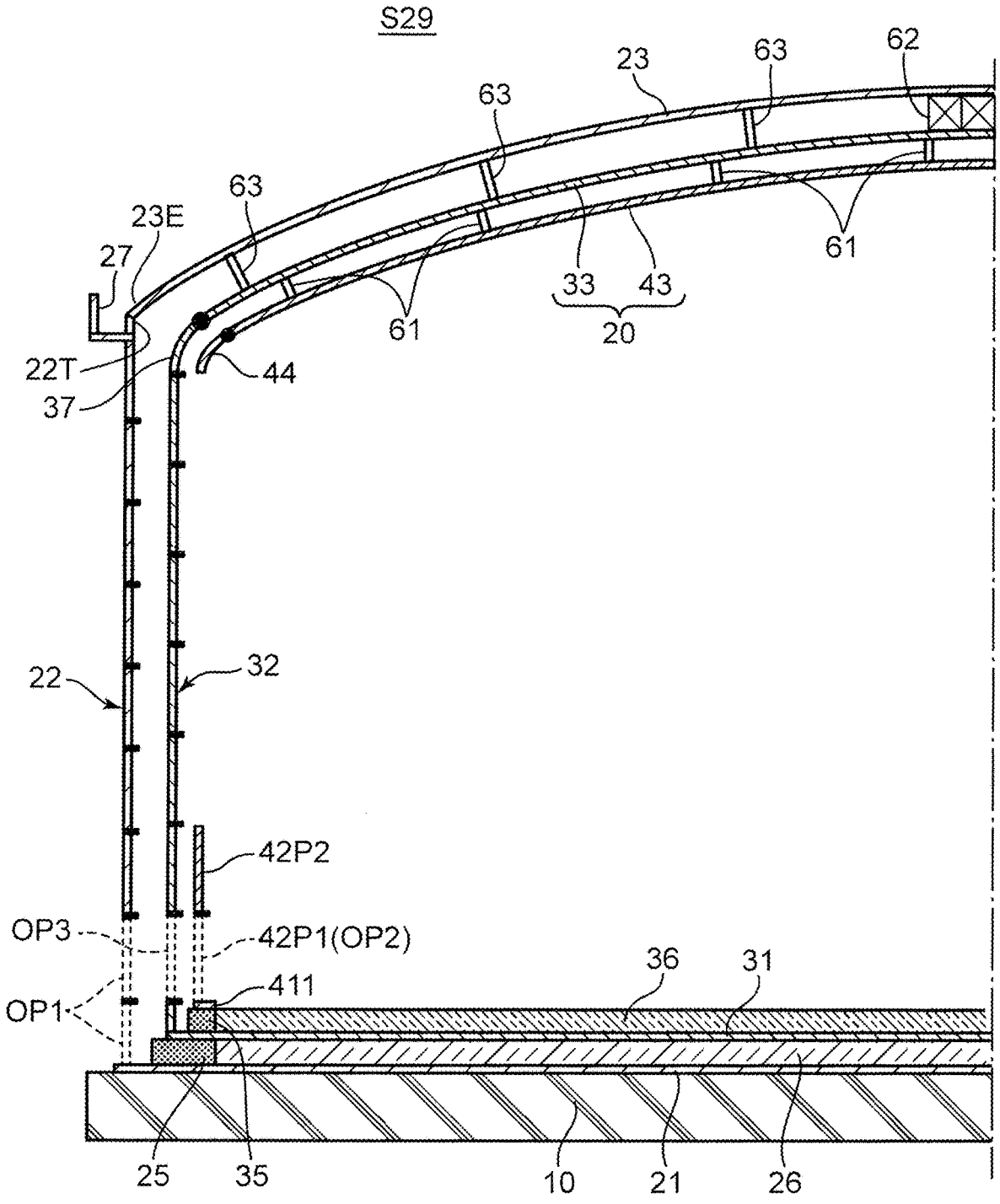
FIG. 22 is a view illustrating one process of the method for constructing the triple shell tank.

FIG. 22 illustrates a construction status in process S29. In process S29, installation of the inner tank side plate 42 is started, and the installation of the outer tank roof 23 is continued. Regarding the inner tank side plate 42, the inner tank side plate piece 42P1 constituting the lowermost circular step of the inner tank side plate 42 and the inner tank side plate piece 42P2 constituting the second circular step are installed on the inner tank annular 411. As shown in the chart of FIG. 16, at this step, the second opening OP2 is opened the lowermost circular step of the inner tank side plate 42 as a construction opening. In this manner, in the second embodiment, the inner tank side plate 42 is installed inside the intermediate tank side plate 32 after air-raising. That is, installation work of the inner tank side plate 42 can be performed in a state of being covered with the intermediate tank 3. Accordingly, there is also an advantage that the installation work of the inner tank 4 is hardly affected by the weather.

Regarding the outer tank roof 23, the outer tank roof 23 having a dome shape is finally formed by connecting the outer tank roof block assembled in advance by ground work to the outer tank roof piece 23P at the radial center placed in process S28. During this extension, an outer tank roof periphery support 63 (temporary support) made of H steel or the like is disposed at an appropriate location between the intermediate tank roof 33 and the outer tank roof 23. Thereafter, an outer peripheral edge 23E of the outer tank roof 23 is fixed to the top part 22T of the outer tank side plate 22. In process S29, the inner bottom portion cool layer 36 is laid further on the intermediate tank bottom plate 31 (second level concrete layer 34).

<Process S30>

Figure 23:
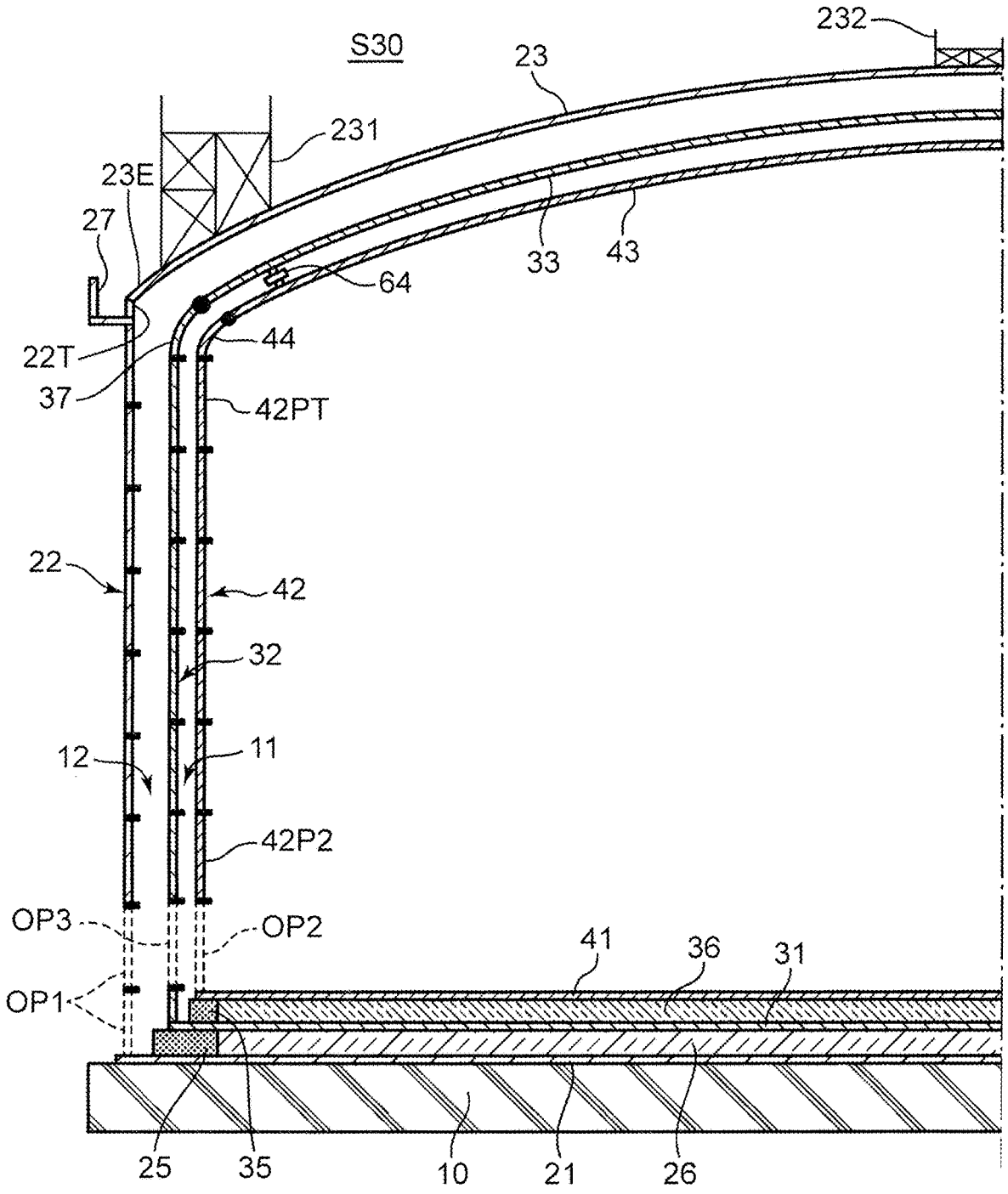
FIG. 23 is a view illustrating one process of the method for constructing the triple shell tank.

FIG. 23 illustrates a construction status in process S30. In process S30, the inner tank side plate 42 is installed, and fixing of the inner tank roof 43 and the inner tank side plate 42 is performed. Regarding the inner tank side plate 42, side plate pieces constituting a further upper circular step are sequentially installed on the inner tank side plate pieces 42P2 constituting the second circular step. Finally, the inner tank side plate piece 42PT constituting the uppermost circular step is installed.

After the installation of the uppermost inner tank side plate piece 42PT, work of releasing the temporary fixing of the connected roof body 20 and fixing the inner tank roof 43 and the inner tank side plate 42 is performed. Prior to this fixing work, a replacement work of replacing the intermediate tank roof support 61 connecting the intermediate tank roof 33 and the inner tank roof 43 with a jack 64 is performed. In a state where the temporary fixing of the connected roof body 20 is not released after air-raising, the inner tank roof 43 is suspended from the intermediate tank roof 33 with the intermediate tank roof support 61 at a position higher than a normal height position. This is for securing an adjustment space when the inner tank roof 43 is connected to the inner tank side plate 42.

The jack 64 is disposed at an appropriate location between the intermediate tank roof 33 and the inner tank roof 43, and suspends and supports the inner tank roof 43 movably up and down after the replacement. The lower end of the inner tank knuckle plate 44 and the upper end of the uppermost inner tank side plate piece 42PT are aligned while the inner tank roof 43 is jacked down with the jack 64 by the amount of the adjustment space. After the alignment, the both are fixed. The inner tank bottom plate 41 is laid on the inner bottom portion cool layer 36. Through the work, the inner tank 4 is substantially completed.

A shoulder part deck 231 and a top part deck 232 are installed on the outer tank roof 23. In the present embodiment, the installation of the outer tank side plate 22 and the fixing of the outer tank side plate 22 and the outer tank roof 23 are completed in process S29 prior to the installation of the inner tank side plate 42 started after the air-raising. The outer tank 2 is often required to be equipped with accessories such as a pipe for a liquid to be stored and a deck. FIG. 23 illustrates equipment of the shoulder part deck 231 and the top part deck 232. According to the present embodiment, since the installation of the outer tank side plate 22 precedes the installation of the inner tank side plate 42, the outer tank 2 can be instantaneously completed. Accordingly, equipping work of the accessory such as the shoulder part deck 231 and the top part deck 232 becomes possible to execute in parallel with the installation of the inner tank side plate 42, which can contribute to shortening of the construction period.

<Process S31>

Figure 24:
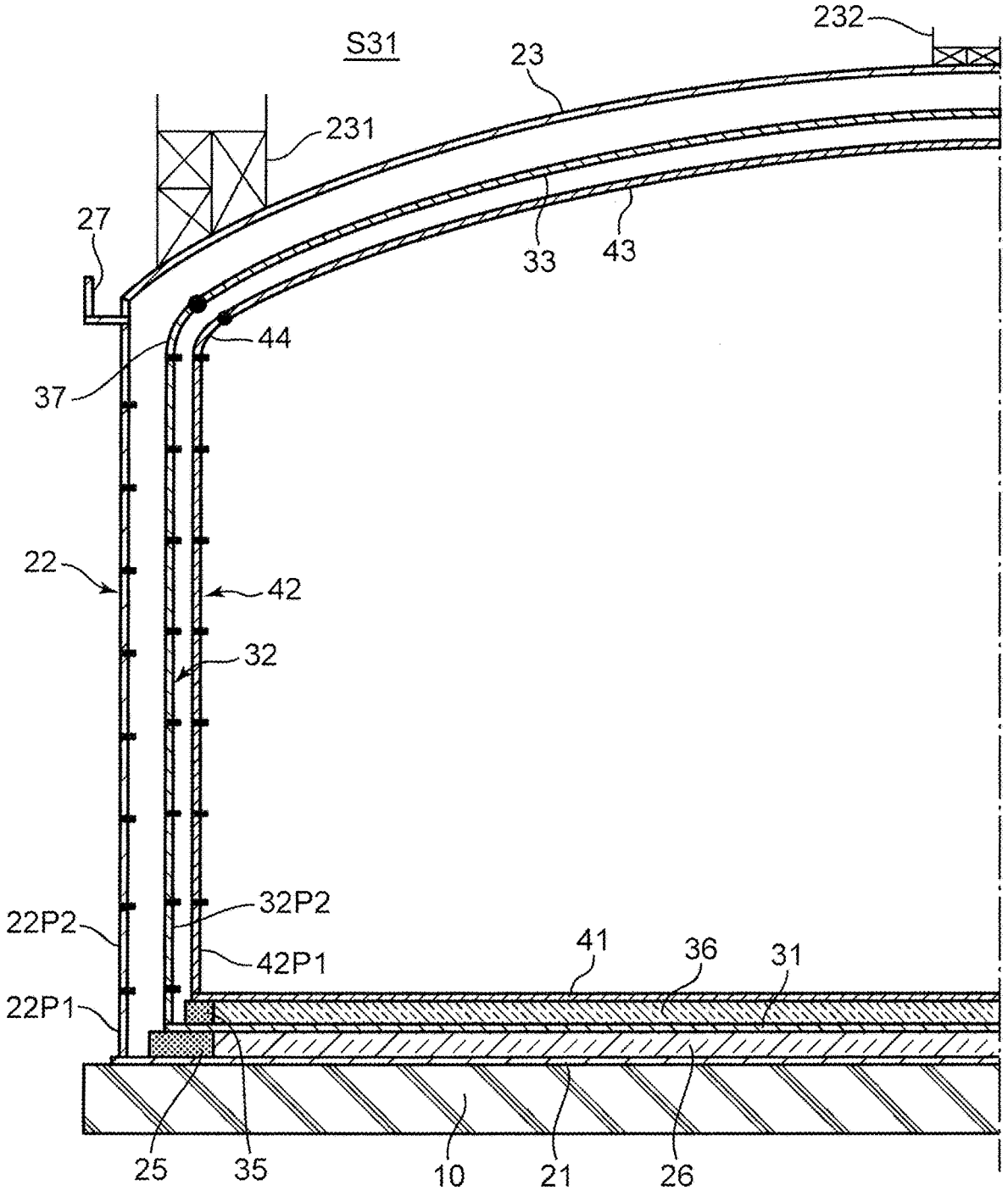
FIG. 24 is a view illustrating one process of the method for constructing the triple shell tank.

FIG. 24 illustrates a construction status in process S31. In process S31, sealing of the first opening OP1, the second opening OP2, and the third opening OP3 is performed. The second opening OP2 is sealed after the work inside the inner tank 4 is completed and the scaffold or the like placed inside the inner tank 4 is removed. This sealing work is work of fitting and welding the inner tank side plate piece 42P1 into the second opening OP2. Subsequently, after the work inside the intermediate tank 3 is completed and the scaffold and the like are removed, the third opening OP3 is sealed. The sealing work is fitting and welding of the pulled out intermediate tank side plate piece 32P2 into the third opening OP3. Finally, after the work inside the outer tank 2 is completed and the scaffold and the like are removed, the first opening OP1 is sealed. The sealing work is work of fitting the pulled out outer tank side plate pieces 22P1 and 22P2 so as to close the first opening OP1 over the two circular steps and welding them.

Third Embodiment; Inner Vessel Roof—Intermediate Vessel Side Plate AR Method

In the second embodiment (intermediate tank AR method) described above, an example has been described in which when the connected roof body 20 is air-raised, the sealing process is performed between the intermediate tank side plate 32 and the intermediate tank roof 33 as described with reference to process S27 and FIG. 20. In the third embodiment, as a modification of the second embodiment, an example in which a sealing process is performed between the intermediate tank side plate 32 and the inner tank roof 43 will be described. That is, in the third embodiment, what is used as the guide side plate at the time of air-raising is the intermediate tank side plate 32 similarly to the second embodiment, but what is used for formation of the sealed space is not the intermediate tank roof 33 but the inner tank roof 43.

<Process S27A>

Figure 25:
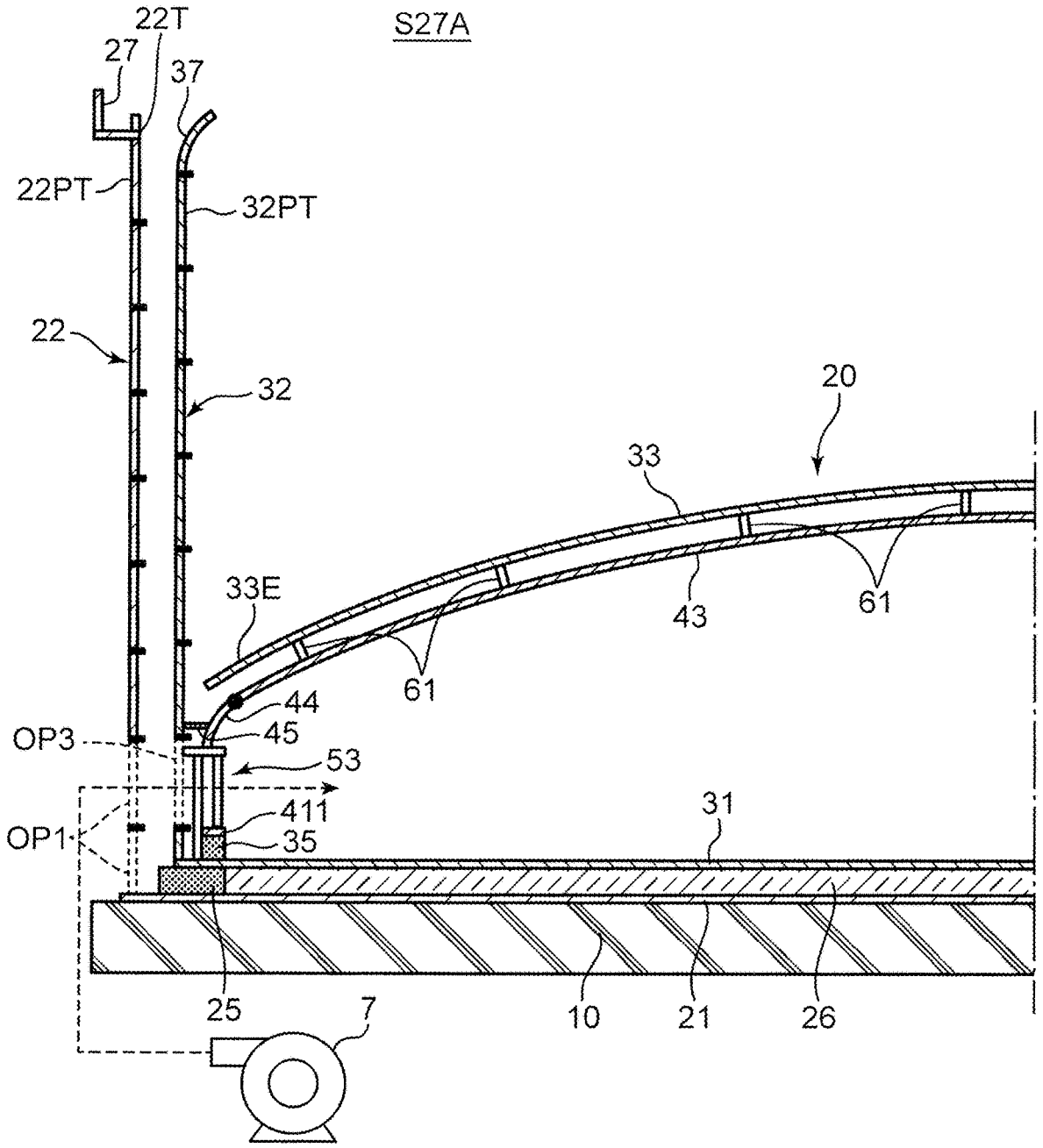
FIG. 25 is a view illustrating, with a cross section of half of the tank, one process of the method for constructing the triple shell tank according to the third embodiment.
Figure 26:
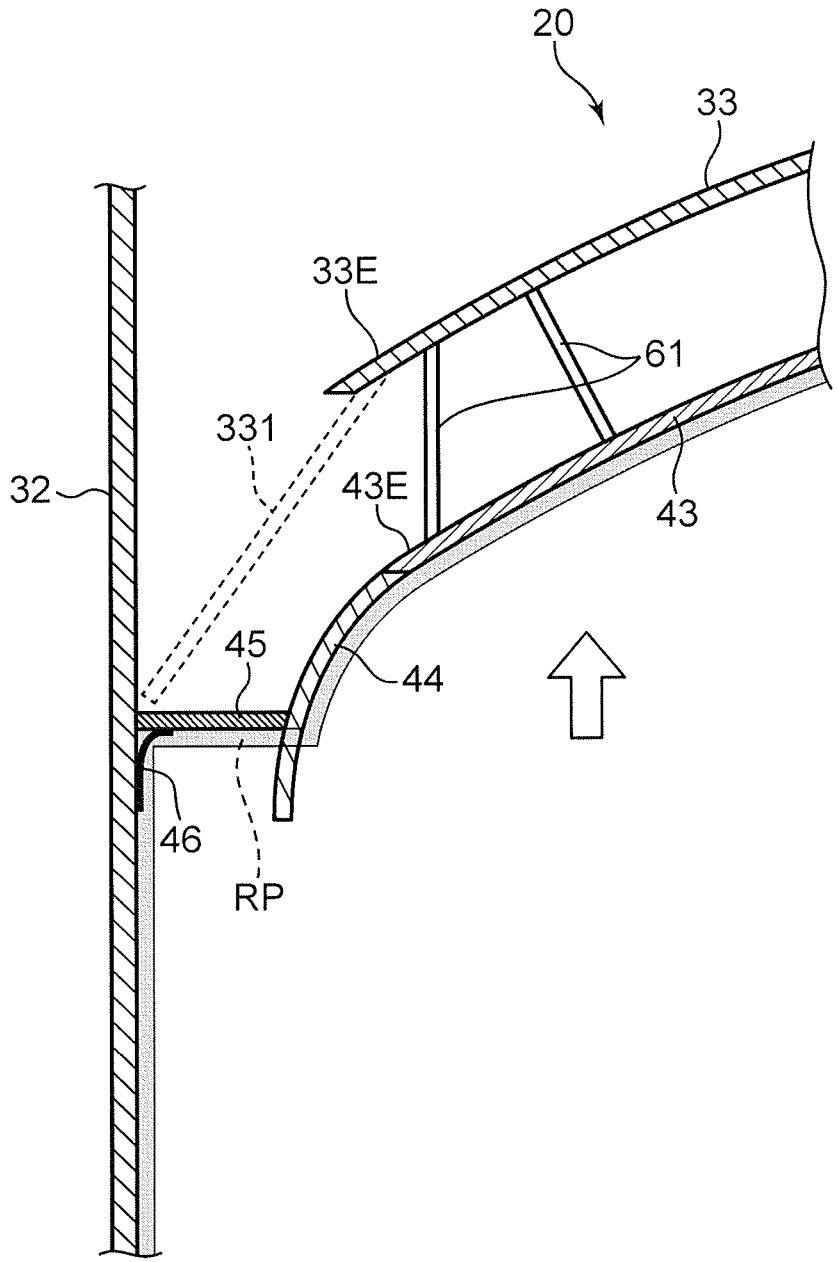
FIG. 26 is a cross-sectional view illustrating a sealing process structure between an inner tank roof and an intermediate tank side plate.

FIG. 25 is a view illustrating a construction state in process S27A in the method for constructing the triple shell tank 1 according to the third embodiment. FIG. 26 is an enlarged view of a main part of FIG. 25. In process S27A, preparation work for air-raising is mainly performed. Since the construction work before reaching process S27A is substantially the same as processes S21 to S26 (see FIGS. 3 to 5 and FIGS. 17 to 19) of the second embodiment, the description thereof is omitted here. However, in the construction status of process S26 of the second embodiment illustrated in FIG. 19, the outer peripheral edge 33E of the intermediate tank roof 33 is attached with the temporary roof 331 having an umbrella shape, but the third embodiment is different in being not attached with the temporary roof 331.

As the preparation work for the air-raising, attachment of a temporary roof 45 to the inner tank roof 43 is performed. The outer peripheral edge 43E of the inner tank roof 43 is attached with the inner tank knuckle plate 44 connecting the inner tank side plate 42 and the inner tank roof 43. The temporary roof 45 is a metal flat plate having a circular ring shape closing a space between the inner tank knuckle plate 44 and the inner face of the intermediate tank side plate 32. The temporary roof 45 is fixed to a surface side of the inner tank knuckle plate 44 by a method such as screwing or welding.

The temporary roof 45 is mounted with a sealing material 46. The sealing material 46 is a cloth-like member that seals a gap between the temporary roof 45 and the inner face of the intermediate tank side plate 32. In the third embodiment, a region surrounded by the intermediate tank bottom plate 31, the intermediate tank side plate 32, and the inner tank roof 43 becomes a sealed region RP. The point that the blower 7 that supplies air for air-raising is prepared, and the blowing duct of the blower 7 is drawn into the inner side of the intermediate tank side plate 32 through the first opening OP1 and the third opening OP3, and the point that the uppermost step of the intermediate tank side plate 32 is attached with the intermediate tank knuckle plate 37 are similar to process S27 of the second embodiment.

In FIG. 26, the temporary roof 331 to be attached to the outer peripheral edge 33E of the intermediate tank roof 33 at the time of air-raising in the second embodiment is indicated by the dotted line. In the intermediate tank AR of the second embodiment, since the intermediate tank side plate 32 is used as the guide side plate, the air-raising cannot be performed in a state where the intermediate tank knuckle plate 37 is equipped on the connected roof body 20. Therefore, it is necessary to seal a relatively long distance between the outer peripheral edge 33E of the intermediate tank roof 33 and the inner face of the intermediate tank side plate 32. Moreover, it becomes necessary to have a seal structure having an inclination that can avoid interference with the intermediate tank knuckle plate 37 assembled on the uppermost step of the intermediate tank side plate 32. In order to satisfy such requirement, the temporary roof 331 has a tapered shape that expands radially outward as it goes downward. The temporary roof 331 having such shape increases in size and weight, and makes assembly and disassembly work thereof difficult.

On the other hand, in the inner tank roof-intermediate tank side plate AR of the third embodiment, it is sufficient to seal a relatively narrow space between the inner tank knuckle plate 44 positioned at the outer peripheral edge 43E of the inner tank roof 43 and the inner face of the intermediate tank side plate 32. Therefore, it is sufficient to attach the relatively small temporary roof 45 to the inner tank knuckle plate 44. By selecting a position not interfering with the intermediate tank knuckle plate 37 as a seal position in a state where the connected roof body 20 is air-raised to the uppermost step, the temporary roof 45 can be a horizontal circular disk having the shortest seal distance. Such the temporary roof 45 can achieve significant reduction in size and weight as compared with the temporary roof 331 having an umbrella shape described above, and can be simplify and facilitate assembly and disassembly work thereof. For example, the temporary roof 45 can be divided into a plurality of circular ring pieces and attached to the inner tank knuckle plate 44 at the time of assembly, and can be disassembled into the circular ring pieces and unloaded at the time of disassembly, thereby improving workability. Since the temporary roof 45 is horizontal, the temporary roof 45 can also be utilized as a scaffold for other work.

<Process S28A>

Figure 27:
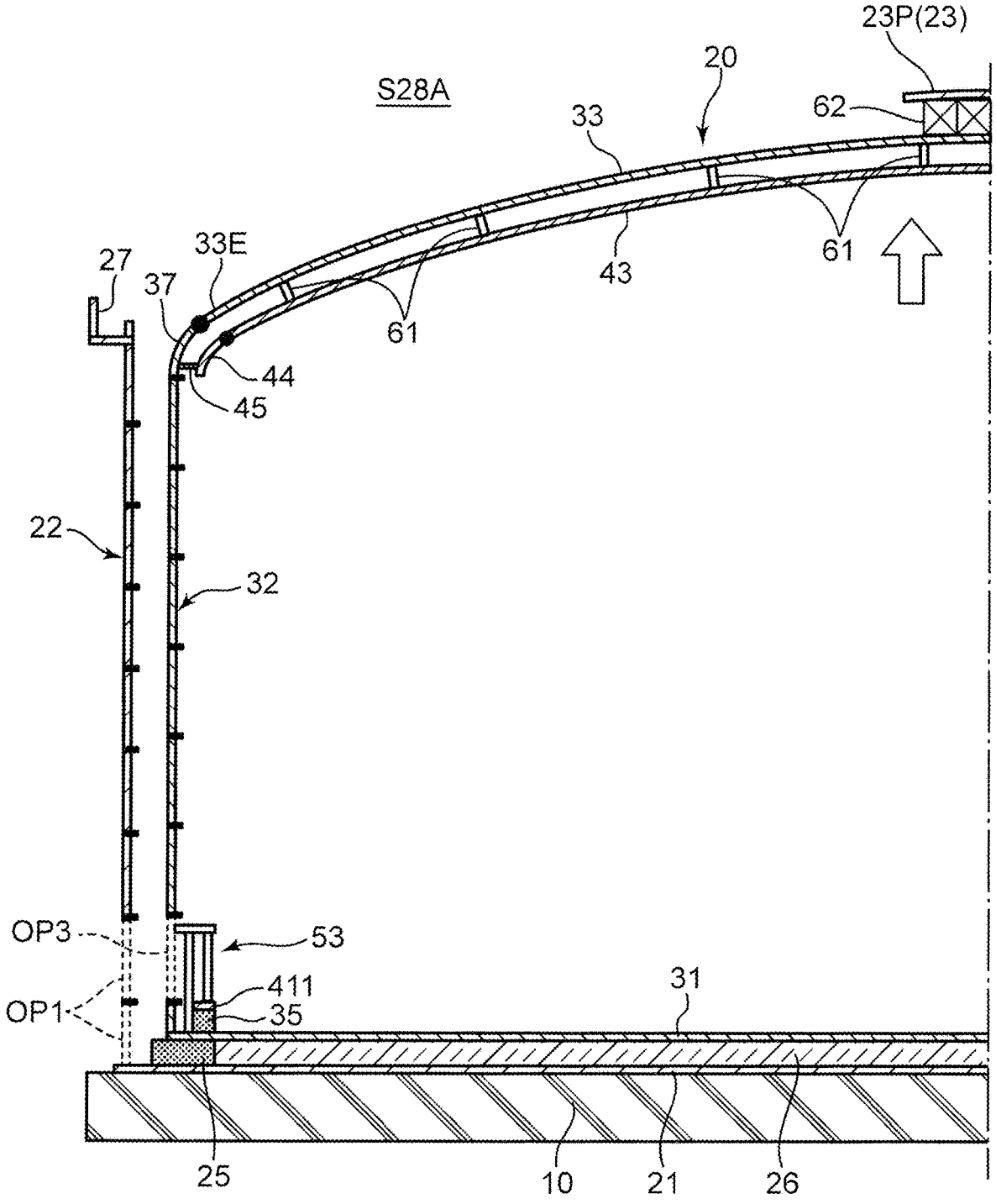
FIG. 27 is a view illustrating one process of the method for constructing the triple shell tank.

FIG. 27 illustrates a status in process S28A corresponding to a state after performing of air-raising. In executing air-raising, the blower 7 illustrated in FIG. 25 is operated, and air is supplied to the sealed space surrounded by the intermediate tank bottom plate 31, the intermediate tank side plate 32, and the inner tank roof 43. Air pressure in the sealed space is increased by air supply, and the connected roof body 20 is floated by the pressure. At this time, the intermediate tank side plate 32 plays a role as a guide of the floating connected roof body 20. The temporary roof 45 functions as a seal structure that fills a space between the intermediate tank side plate 32 and the inner tank roof 43. By air-raising the connected roof body 20, it is possible to float the inner tank roof 43 and the intermediate tank roof 33 at once.

After the air-raising, the temporary roof 45 is disassembled, and the intermediate tank roof 33 and the intermediate tank side plate 32 are fixed by the intermediate tank knuckle plate 37. The subsequent construction work is similar to processes S29 to S31 (FIGS. 22 to 24) of the second embodiment. That is, work such as installation of the inner tank side plate 42, installation of the outer tank roof 23, release of temporary fixing of the connected roof body 20, and fixing of the inner tank roof 43 and the inner tank side plate 42 are executed. Since these are identical to those of the second embodiment, the description thereof is omitted here.

Actions and Effects

According to the method for constructing a triple shell tank according to the present disclosure described above, the connected roof body 20 in which the inner tank roof 43 and the intermediate tank roof 33 are temporarily fixed is formed before air-raising. Specifically, the intermediate tank roof 33 is temporarily fixed on the inner tank roof 43 by the intermediate tank roof support 61. Subsequently, after the inner tank side plate 42 (first embodiment) or the intermediate tank side plate 32 (second embodiment) serving as a guide side plate is installed around the connected roof body 20, the connected roof body 20 is air-raised. The inner tank roof 43 and the intermediate tank roof 33 can be integrally floated by the air-raising of the connected roof body 20. That is, the inner tank roof 43 and the intermediate tank roof 33 are prepared by ground work, temporarily fixed, and integrated, and floated at once by one time of air-raising. Therefore, most of the installation work of the inner tank roof 43 and the intermediate tank roof 33 can be executed by a low-place work in parallel with the installation work of the side plates 22, 32, and 42, and the like. Accordingly, the construction period of the triple shell tank 1 can be shortened.

Modified Embodiments

Although the embodiments of the method for constructing a triple shell tank according to the present disclosure have been described above, the present disclosure is not limited to the above embodiments at all. For example, the method for constructing the triple shell tank described above can assume the following modified embodiments.

(1) In the above embodiment, an example has been described in which the installation of the outer tank roof 23 is started on the connected roof body 20 after the connected roof body 20 is air-raised. In this case, it is possible to adopt a method of conveying, using a tall crane or the like, a plurality of the outer tank roof pieces 23P constituting the outer tank roof 23 onto the connected roof body 20 after air-raising. Alternatively, the air-raising may be executed in a state where the outer tank roof piece 23P is mounted on the intermediate tank roof 33 of the connected roof body 20.

Figure 28:
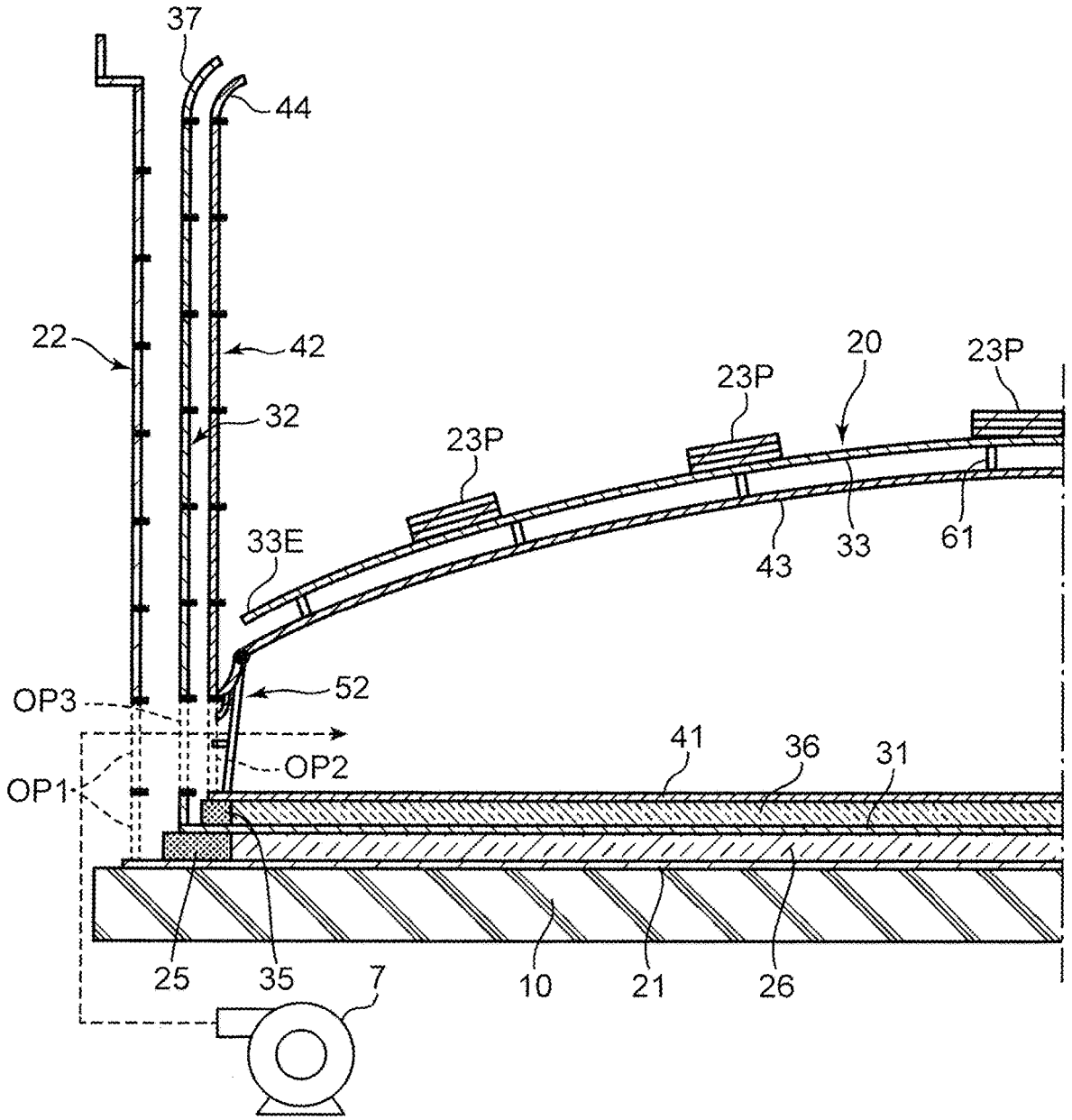
FIG. 28 is a view illustrating a method for air-raising according to a modification.

FIG. 28 is a view illustrating the method for air-raising according to a modification. FIG. 28 illustrates a process corresponding to the preparation process of air-raising in process S10 of the inner tank AR method illustrated in FIG. 12. A bundle of the outer tank roof pieces 23P is stacked on the intermediate tank roof 33 of the connected roof body 20. In this case, it is desirable to load the outer tank roof pieces 23P so that the weight balance of the connected roof body 20 is not lost, and for example, the outer tank roof pieces 23P can be circularly arrayed on the upper surface of the intermediate tank roof 33. According to this modification, the outer tank roof pieces 23P are simultaneously floated together with the connected roof body 20 at the time of air-raising. Therefore, in installation work of the outer tank roof 23 performed after the air-raising, it is possible to save the time and effort of carrying the outer tank roof piece 23P onto the intermediate tank roof 33 using a tall crane or the like.

(2) A necessary construction structure and equipment may be provided in the vicinity of the triple shell tank 1 described above. For example, a dike that suppresses diffusion when liquid in the tank leaks at the time of disaster or the like may be erected around the triple shell tank 1. The dike can be installed with prestressed concrete (PC), for example. The dike may be integrally constructed with the outer tank 2 made of metal. Specifically, an aspect in which the PC constituting the dike is installed in a state of being in close contact with the outer peripheral surface of the outer tank side plate 22 may be adopted.

(3) Various structures for reinforcing the strength of the triple shell tank 1 may be added. For example, an anchor strap for connecting the intermediate tank side plate 32 and/or the inner tank side plate 42 and the tank base 10 may be included.

(4) A communication pipe for causing the internal space of the inner tank 4 and the space the first inter-vessel 11 to communicate with each other may be attached to the inner tank roof 43. According to this modification, the hydrogen gas vaporized from the liquid hydrogen LH stored in the inner tank 4 can be circulated the first inter-vessel 11. That is, the cooling effect can be enhanced by using the stored liquid hydrogen LH.

(5) In the embodiment described above, an example has been described in which the first opening OP1, the second opening OP2, and the third opening OP3 are opened at substantially the same height at the same position in the circumferential direction of the triple shell tank 1. These openings OP1, OP2, and OP3 may be opened at different positions in the circumferential direction of the triple shell tank 1, or may be opened at different heights.

(6) In the above embodiments, an example has been described in which after the connected roof body 20 of the inner tank roof 43 and the intermediate tank roof 33 is air-raised, the assembly of the outer tank roof 23 is started on the connected roof body 20 (process S12 in FIG. 14 and process S28 in FIG. 21). Alternatively, before air-raising of the connected roof body 20, a part of the outer tank roof 23 may be assembled in advance on the connected roof body 20 by ground work, and the remaining part of the outer tank roof 23 may be assembled after the air-raising. The part of the outer tank roof 23 assembled by ground work may be within a range in which interference with the inner tank side plate 42 or the intermediate tank side plate 32 serving as a guide during air-raising does not occur in the inner tank AR method or the intermediate tank AR method.

Summary of Present Disclosure

The specific embodiments described above include a disclosure having the following configurations.

A method for constructing a triple shell tank according to the present disclosure is a method for constructing a triple shell tank including an inner tank, an intermediate tank, and an outer tank each having a roof and a side plate, the method including: temporarily fixing an intermediate tank roof onto an inner tank roof to form a connected roof body; installing a guide side plate having a predetermined height around the connected roof body; performing a sealing process between an outer peripheral edge of the connected roof body and an inner face of the guide side plate to form a sealed space, and supplying air to the sealed space to air-raise the connected roof body; and forming at least a part of an outer tank roof on the intermediate tank roof of the air-raised connected roof body, and installing an outer tank side plate around the guide side plate.

According to this construction method, the connected roof body in which the inner tank roof and the intermediate tank roof are temporarily fixed is formed before air-raising. Subsequently, after a guide side plate is installed around the connected roof body, the connected roof body is air-raised. Note that the guide side plate can be installed as an inner tank side plate or an intermediate tank side plate. The inner tank roof and the intermediate tank roof can be integrally floated by the air-raising of the connected roof body. That is, the inner tank roof and the intermediate tank roof are prepared by ground work, temporarily fixed, and integrated, and floated at once by one time of air-raising. Accordingly, most of the installation work of the inner tank roof and the intermediate tank roof can be executed by a low-place work in parallel with the installation work of the side plate and the like, which contributes to shortening of the construction period.

In the method for constructing a triple shell tank, it is desirable that a temporary support be placed on the intermediate tank roof of the air-raised connected roof body; and the outer tank roof be installed on the temporary support, and subsequently the outer tank roof and the outer tank side plate be fixed.

According to this construction method, the outer tank can be efficiently installed by a method of assembling the outer tank roof on the connected roof body after air-raising, and then fixing the outer tank roof and the outer tank side plate.

In the method for constructing a triple shell tank, a construction method can be adopted in which the guide side plate is an inner tank side plate, and an intermediate tank side plate having a predetermined height is installed around the inner tank side plate, in the air-raising, a sealing process is performed between an outer peripheral edge of the inner tank roof and an inner face of the inner tank side plate to form a sealed space, and after the air-raising, the inner tank roof and the inner tank side plate are fixed, subsequently the temporary fixing of the connected roof body is released to fix the intermediate tank roof and the intermediate tank side plate.

According to this construction method, the connected roof body is air-raised with the inner tank side plate as a guide. In this case, what is directly air-raised is the inner tank roof, but the intermediate tank roof can also be integrally floated in an aspect of being supported from below by the inner tank roof.

In this case, it is desirable that an inner tank bottom plate constituting a bottom part of a region surrounded by the inner tank side plate be formed at least before the air-raising.

According to this construction method, in a case where the inner tank roof is a direct air-raising target, by forming the inner tank bottom plate in advance, it is possible to facilitate formation of a sealed space necessary for air-raising.

In the method for constructing a triple shell tank, it is desirable that the inner tank side plate, the intermediate tank side plate, and the outer tank side plate be assembled by stacking a plurality of circular steps formed by arranging a plurality of side plate pieces in a circular ring shape, and the circular step of the inner tank side plate, the circular step of the intermediate tank side plate, and the circular step of the outer tank side plate be stacked in parallel.

In the case where the inner tank roof is a direct air-raising target, the intermediate tank side plate and the outer tank side plate disposed outside the inner tank side plate can be installed without being limited to the installation work of the connected roof body performed in ground work. Accordingly, the installation work of the intermediate tank side plate and the outer tank side plate can be performed in parallel with the installation work of the inner tank side plate, that is, the three side plates can be installed simultaneously in parallel. Adoption of such a construction method can achieve improvement of work efficiency such as sharing a scaffold, for example, in installation of the three side plates, and eventually contributes to shortening of the construction period.

In the method for constructing a triple shell tank, it is desirable that the inner tank side plate and the intermediate tank side plate be assembled by stacking a plurality of circular steps formed by arranging a plurality of side plate pieces in a circular ring shape, and the circular step of the inner tank side plate be assembled to an uppermost step prior to the intermediate tank side plate to fix the circular step of the uppermost step and the outer peripheral edge of the inner tank roof.

According to this construction method, since the roof and the side plate of the inner tank positioned inside relative to the intermediate tank are fixed first, workability can be improved as compared with a case where the roof and the side plate of the intermediate tank are fixed in advance.

In the method for constructing a triple shell tank, a method for constructing can be adopted in which the guide side plate is an intermediate tank side plate, in the air-raising, a sealing process is performed between an outer peripheral edge of the intermediate tank roof and an inner face of the intermediate tank side plate to form a sealed space, after the air-raising, an inner tank side plate having a predetermined height is installed inside the intermediate tank side plate, and the intermediate tank roof and the intermediate tank side plate are fixed, subsequently the temporary fixing of the connected roof body is released to fix the inner tank roof and the inner tank side plate.

According to this construction method, the connected roof body is air-raised with the intermediate tank side plate as a guide. In this case, what is directly air-raised is the intermediate tank roof, but the inner tank roof can also be integrally floated in an aspect of being suspended from the intermediate tank roof. After the air-raising, the inner tank side plate is installed inside the intermediate tank side plate. That is, installation work of the inner tank side plate can be performed in a state of being covered with the intermediate tank. Accordingly, there is also an advantage that the installation work of the inner tank is hardly affected by the weather.

In this case, it is desirable that an intermediate tank bottom plate constituting a bottom part of a region surrounded by the intermediate tank side plate be formed at least before the air-raising.

According to this construction method, in a case where the intermediate tank roof is a direct air-raising target, by forming the intermediate tank bottom plate in advance, it is possible to facilitate formation of a sealed space necessary for air-raising.

In the method for constructing a triple shell tank, it is desirable that the intermediate tank side plate and the outer tank side plate be assembled by stacking a plurality of circular steps formed by arranging a plurality of side plate pieces in a circular ring shape, and the circular step of the intermediate tank side plate and the circular step of the outer tank side plate be stacked in parallel.

In a case where the intermediate tank roof is a direct air-raising target, the outer tank side plate disposed outside the intermediate tank side plate can be installed without being limited to the installation work of the connected roof body performed in ground work. Accordingly, the installation work of the outer tank side plate can be performed in parallel with the installation work of the intermediate tank side plate. Adoption of the construction method described above can achieve improvement of work efficiency such as sharing a scaffold, for example, in installation of the outer tank side plate and the intermediate tank side plate, and eventually contributes to shortening of the construction period.

In the method for constructing a triple shell tank, it is desirable that the outer tank side plate be installed prior to installation of the inner tank side plate after the air-raising.

The outer tank is often required to be equipped with accessories such as a pipe for a liquid to be stored and a deck. According to the construction method described above, since installation of the outer tank side plate precedes installation of the inner tank side plate, the outer tank can be instantaneously completed. Accordingly, it becomes possible to execute the equipping work of the accessory in parallel with the installation of the inner tank side plate, which can contribute to shortening of the construction period.

In the method for constructing a triple shell tank, a construction method can be adopted in which the guide side plate is an intermediate tank side plate, in the air-raising, a sealing process is performed between an outer peripheral edge of the inner tank roof and an inner face of the intermediate tank side plate to form a sealed space, after the air-raising, an inner tank side plate having a predetermined height is installed inside the intermediate tank side plate, and the intermediate tank roof and the intermediate tank side plate are fixed, subsequently the temporary fixing of the connected roof body is released to fix the inner tank roof and the inner tank side plate.

According to this construction method, the connected roof body is air-raised in a state where the sealing process is performed between the outer peripheral edge of the inner tank roof and the inner face of the intermediate tank side plate with the intermediate tank side plate as a guide. Also in this case, what is directly air-raised is the intermediate tank roof, but the inner tank roof can also be integrally floated in an aspect of being suspended from the intermediate tank roof. Since the sealing process may be performed in a relatively narrow space between the outer peripheral edge of the inner tank roof and the inner face of the intermediate tank side plate, the structure for the sealing process can be downsized. Accordingly, construction for the sealing process can be facilitated.

In the method for constructing a triple shell tank, the outer peripheral edge of the inner tank roof may include an inner tank knuckle plate, and the sealing process may include a process of attaching a temporary roof closing a space between the inner tank knuckle plate and the inner face of the intermediate tank side plate to the inner tank knuckle plate.

According to this construction method, the temporary roof can be significantly downsized as compared with the temporary roof provided when the sealing process is performed between the outer peripheral edge of the intermediate tank roof and the inner face of the intermediate tank side plate. Therefore, the work of assembling and disassembling the temporary roof can be simplified and facilitated.

In the method for constructing a triple shell tank, it is desirable that the air-raising be executed in a state where an outer tank roof piece constituting the outer tank roof is mounted on the intermediate tank roof of the connected roof body.

According to this construction method, the outer tank roof pieces are simultaneously floated together with the connected roof body at the time of air-raising. Therefore, in installation work of the outer tank roof performed after the air-raising, it is possible to save the time and effort of carrying the outer tank roof piece onto the intermediate tank roof using a crane or the like.

In the method for constructing a triple shell tank, it is desirable that a first construction opening, which is a construction entrance, be opened in the outer tank side plate when the outer tank side plate is installed, a second construction opening be opened in the inner tank side plate when the inner tank side plate is installed, and a third construction opening be opened in the intermediate tank side plate when the intermediate tank side plate is installed, the second construction opening be sealed after completion of work inside the inner tank, and then the third construction opening be sealed after completion of work inside the intermediate tank, and subsequently, the first construction opening be sealed after completion of work inside the outer tank.

According to this construction method, the construction opening is timely opened in each of the outer tank side plate, the intermediate tank side plate, and the inner tank side plate to enable various types of construction to be smoothly advanced.

The invention claimed is:

1. A method for constructing a triple shell tank including an inner tank, an intermediate tank, and an outer tank each having a roof and a side plate, the method comprising:

temporarily fixing an intermediate tank roof onto an inner tank roof to form a connected roof body;

installing a guide side plate having a predetermined height around the connected roof body;

performing a sealing process between an outer peripheral edge of the connected roof body and an inner face of the guide side plate to form a sealed space, and supplying air to the sealed space to air-raise the connected roof body; and forming at least a part of an outer tank roof on the intermediate tank roof of the air-raised connected roof body, and installing an outer tank side plate around the guide side plate.

2. The method for constructing a triple shell tank according to claim 1, wherein a temporary support is placed on the intermediate tank roof of the air-raised connected roof body; and the outer tank roof is installed on the temporary support, and subsequently the outer tank roof and the outer tank side plate are fixed.

3. The method for constructing a triple shell tank according to claim 1, wherein the guide side plate is an inner tank side plate, and an intermediate tank side plate having a predetermined height is installed around the inner tank side plate, in the air-raising, a sealing process is performed between an outer peripheral edge of the inner tank roof and an inner face of the inner tank side plate to form a sealed space, and after the air-raising, the inner tank roof and the inner tank side plate are fixed, subsequently the temporary fixing of the connected roof body is released to fix the intermediate tank roof and the intermediate tank side plate.

4. The method for constructing a triple shell tank according to claim 3, wherein an inner tank bottom plate constituting a bottom part of a region surrounded by the inner tank side plate is formed at least before the air-raising.

5. The method for constructing a triple shell tank according to claim 3, wherein the inner tank side plate, the intermediate tank side plate, and the outer tank side plate are assembled by stacking a plurality of circular steps formed by arranging a plurality of side plate pieces in a circular ring shape, and the circular step of the inner tank side plate, the circular step of the intermediate tank side plate, and the circular step of the outer tank side plate are stacked in parallel.

6. The method for constructing a triple shell tank according to claim 3, wherein the inner tank side plate and the intermediate tank side plate are assembled by stacking a plurality of circular steps formed by arranging a plurality of side plate pieces in a circular ring shape, and the circular step of the inner tank side plate is assembled to an uppermost step prior to the intermediate tank side plate to fix the circular step of the uppermost step and the outer peripheral edge of the inner tank roof.

7. The method for constructing a triple shell tank according to claim 1, wherein the guide side plate is an intermediate tank side plate, in the air-raising, a sealing process is performed between an outer peripheral edge of the intermediate tank roof and an inner face of the intermediate tank side plate to form a sealed space, after the air-raising, an inner tank side plate having a predetermined height is installed inside the intermediate tank side plate, and the intermediate tank roof and the intermediate tank side plate are fixed, subsequently the temporary fixing of the connected roof body is released to fix the inner tank roof and the inner tank side plate.

8. The method for constructing a triple shell tank according to claim 7, wherein an intermediate tank bottom plate constituting a bottom part of a region surrounded by the intermediate tank side plate is formed at least before the air-raising.

9. The method for constructing a triple shell tank according to claim 3, wherein the intermediate tank side plate and the outer tank side plate are assembled by stacking a plurality of circular steps formed by arranging a plurality of side plate pieces in a circular ring shape, and the circular step of the intermediate tank side plate and the circular step of the outer tank side plate are stacked in parallel.

10. The method for constructing a triple shell tank according to claim 3, wherein the outer tank side plate is installed prior to installation of the inner tank side plate after the air-raising.

11. The method for constructing a triple shell tank according to claim 1, wherein the guide side plate is an intermediate tank side plate, in the air-raising, a sealing process is performed between an outer peripheral edge of the inner tank roof and an inner face of the intermediate tank side plate to form a sealed space, after the air-raising, an inner tank side plate having a predetermined height is installed inside the intermediate tank side plate, and the intermediate tank roof and the intermediate tank side plate are fixed, subsequently the temporary fixing of the connected roof body is released to fix the inner tank roof and the inner tank side plate.

12. The method for constructing a triple shell tank according to claim 11, wherein the outer peripheral edge of the inner tank roof includes an inner tank knuckle plate, and the sealing process includes a process of attaching a temporary roof closing a space between the inner tank knuckle plate and the inner face of the intermediate tank side plate to the inner tank knuckle plate.

13. The method for constructing a triple shell tank according to claim 1, wherein the air-raising is executed in a state where an outer tank roof piece constituting the outer tank roof is mounted on the intermediate tank roof of the connected roof body.

14. The method for constructing a triple shell tank according to claim 1, wherein a first construction opening, which is a construction entrance, is opened in the outer tank side plate when the outer tank side plate is installed, a second construction opening is opened in the inner tank side plate when the inner tank side plate is installed, and a third construction opening is opened in the intermediate tank side plate when the intermediate tank side plate is installed, the second construction opening is sealed after completion of work inside the inner tank, and then the third construction opening is sealed after completion of work inside the intermediate tank, and subsequently, the first construction opening is sealed after completion of work inside the outer tank.

* * * * *